United States Patent [19]

Lecaroz

[11] Patent Number: 4,873,810

[45] Date of Patent: Oct. 17, 1989

[54] ELEMENTS HAVING A MULTI-DIRECTIONAL CELLULAR STRUCTURE WHOSE INERTIA MAY VARY, AND METHODS OF MANUFACTURE

[76] Inventor: Jean Lecaroz, 6, Place Corneille, 92100 Boulogne, France

[21] Appl. No.: 72,241

[22] PCT Filed: Sep. 23, 1985

[86] PCT No.: PCT/FR85/00259

§ 371 Date: Jul. 6, 1987

§ 102(e) Date: Jul. 6, 1987

[87] PCT Pub. No.: WO87/01789

PCT Pub. Date: Mar. 26, 1987

[51] Int. Cl.[4] ..... E04B 1/62

[52] U.S. Cl. ..... 52/575; 52/574; 52/806; 52/808; 52/809; 52/DIG. 10; 109/1 S; 109/80; 428/117

[58] Field of Search ..... 52/575, 574, 806, 807, 52/808, 809, DIG. 10, 668; 428/117, 542, 116, 118, 73, 593, 911; 109/1 S, 80, 82, 84

[56] References Cited

U.S. PATENT DOCUMENTS

| | | | |
|---|---|---|---|
| 2,077,729 | 4/1937 | Wilcox . | |
| 3,109,766 | 11/1963 | Norris . | |
| 3,170,471 | 2/1965 | Schnitzer . | |
| 3,213,628 | 10/1965 | Serota . | |
| 3,229,649 | 1/1966 | Baker . | |
| 3,504,761 | 4/1970 | Sullivan et al. . | |
| 3,533,894 | 10/1970 | Engelbrecht et al. | 52/806 X |
| 3,611,648 | 10/1971 | Barnett . | |
| 3,737,043 | 6/1973 | Clark . | |
| 3,765,299 | 10/1973 | Pagano . | |
| 4,095,386 | 6/1978 | Johnson . | |
| 4,198,454 | 4/1980 | Norton . | |

FOREIGN PATENT DOCUMENTS

| | | | |
|---|---|---|---|
| 122782 | 1/1947 | Australia | 52/808 |
| 1042430 | 10/1958 | Fed. Rep. of Germany . | |
| 2505730 | 11/1982 | France . | |
| 2548726 | 1/1985 | France . | |
| 30794 | 7/1965 | German Democratic Rep. | 52/79.4 |
| 131640 | 9/1919 | United Kingdom . | |
| 117597 | 9/1984 | United Kingdom . | |

OTHER PUBLICATIONS

*Order in Space,* Keith Critchlow, ©1969, Appendix 2.

*Primary Examiner*—Richard E. Chilcot, Jr.
*Attorney, Agent, or Firm*—Mason, Fenwick & Lawrence

[57] ABSTRACT

The invention relates to the construction of a self-supporting body of cellular structure, great rigidity, and capable of withstanding stresses exerting in all directions, either separately or together, of withstanding impacts, pressure, shock waves, acoustical and thermal phenomena, and using free volumes as assemblies having different characteristics or as shock absorbing means. The invention also provides the possibility of varying the weight of said body by being filled with various fluids which may be static or flowing, which may be at various different pressures, and which may contain specialized agents on a permanent basis or which may be put into action under certain constraints of pressure, temperature, etc.

39 Claims, 31 Drawing Sheets

FIGURE 7
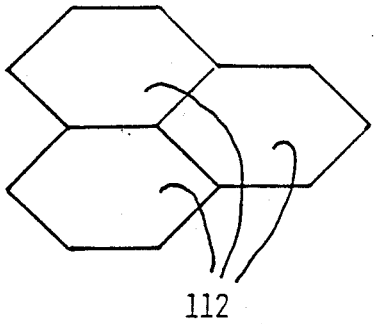
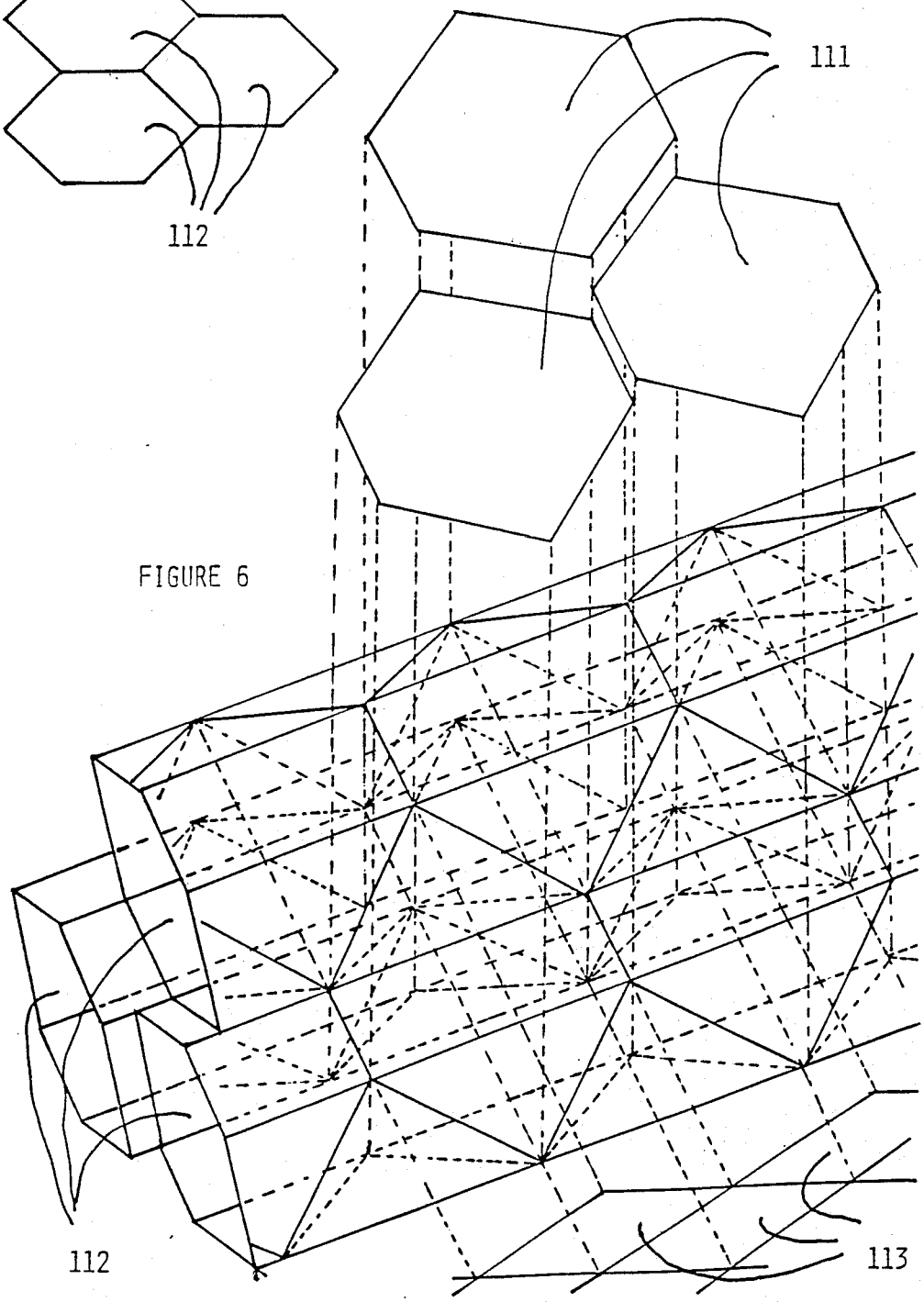
FIGURE 6

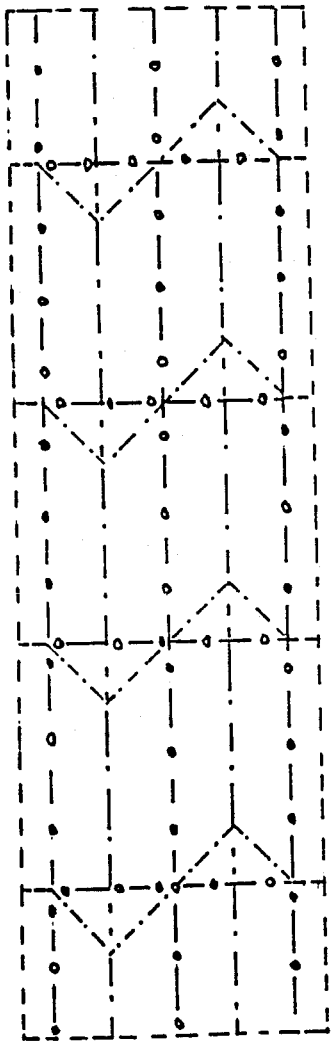
FIGURE 10 B
FIGURE 10
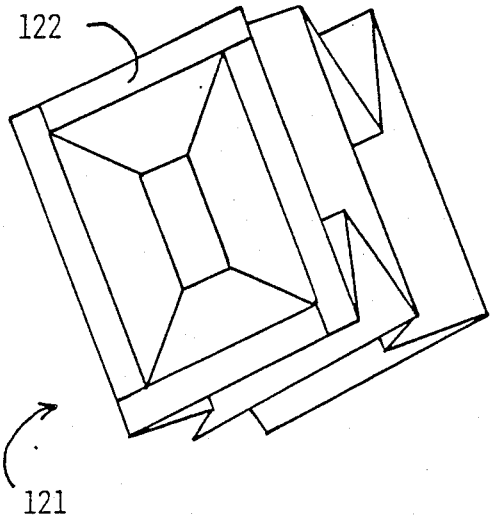
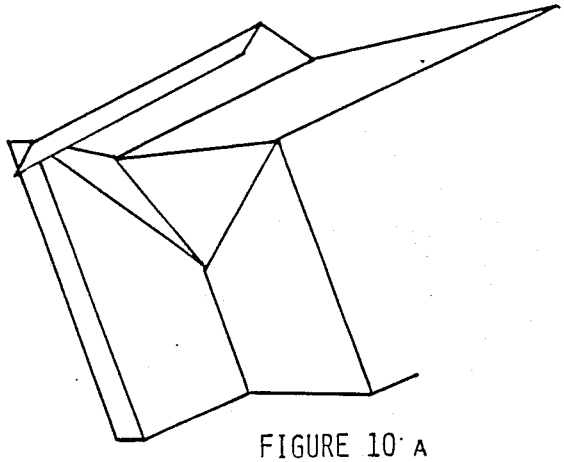
FIGURE 10 A

FIGURE 13
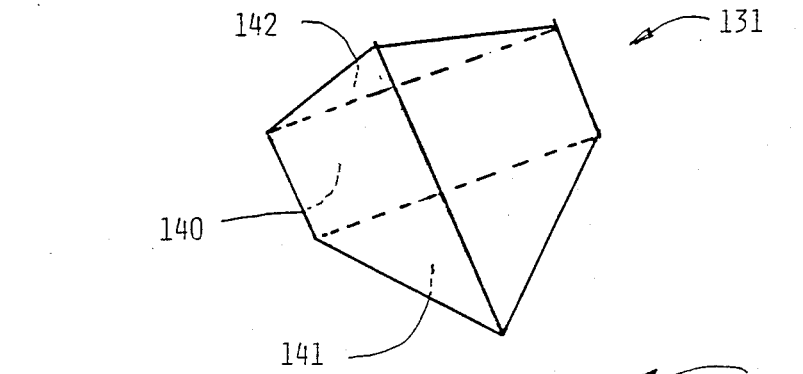
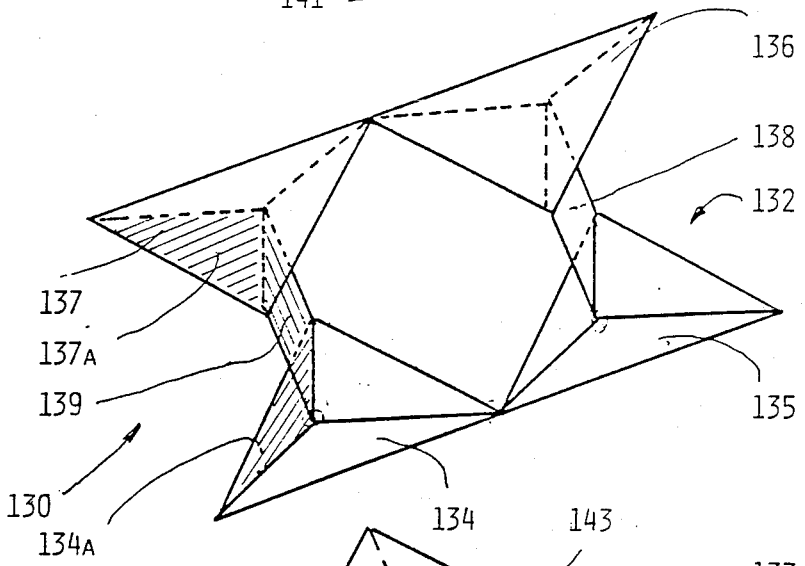
FIGURE 13 A
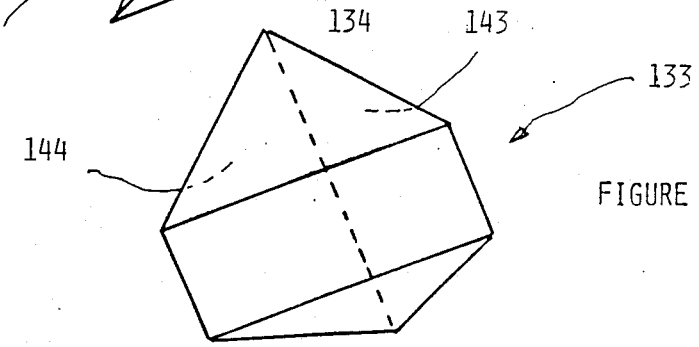
FIGURE 13 B

ELEMENTS HAVING A MULTI-DIRECTIONAL CELLULAR STRUCTURE WHOSE INERTIA MAY VARY, AND METHODS OF MANUFACTURE

The present invention relates to an element whose structure is strong in multiple directions, to methods of manufacturing it, and to applications of said element.

Constructions have been known for a long time, of which the commonest type is hexagonal in section and is called a "honeycomb".

They are widely used, in particular for building-panels, for sound-proofing panels, for spacecraft and for aircraft, and for structural reinforcements of shapes having exceptional mechanical properties, in general and when seeking the best possible weight/performance ratio for high dimensional stability in spite of various constraints, phenomena, or environments.

The generalization of applications of such structures is, however, limited by causes inherent to their design: their greater ultimate breaking strength is effective in one direction only (orthogonally to the parallel planes defined by their outside surfaces), and they have low shear strength along their planes of discontinuity.

They are incapable of supporting certain point compressive loads such as assembly rods or impacts.

They are unusable for thick structures which must withstand forces being applied in several directions.

The subject matter of the present invention is the construction of a self-supporting cellular body of great rigidity and capable of standing up to stresses exerted in many directions, either together or separately, to impacts, to pressures, to shock waves, and to acoustic and thermal phenomena, by using the available free volumes as assemblies of different characteristics or as shock absorbing means, and capable of varying the weight of the body by being filled with various fluids which may be static or flowing, at different pressures, and including permanent specialized agents or which may be put into action under certain constraints of pressure, temperature, etc.

This result is obtained, in accordance with the present invention, by an element whose structure has multi-directional strength, and which is characterized in that it is constituted by a superposition and a juxtaposition of layers of convex closed prismatic shells, with the cells in each layer having shapes which are determined by the intersections of series of the closed shells which are mutually parallel within each series and are the same size in the direction extending transversely to the layer.

In general, a construction including an element in accordance with the invention advantageously includes an envelope delimiting its volume. The envelope may constitute an integral portion of the structure.

All of the intersecting planes defining the cells are continuous along various axes up to the limits of the envelope. The envelope is divided into elements whose consecutive planes of similar or different thicknesses or natures are assembled in combinations capable of intercommunication or of isolation from one another and depending on the desired characteristics of the construction formed in this way.

In accordance with the invention, an element is thus constituted by assembling identical cells which are juxtaposed in repetitive manner in all three directions to constitute a cellular or honeycomb structure.

In one embodiment, the cells are square or rectangular in section in planes perpendicular to all three directions. In another embodiment, the cells are hexagonal in section in planes which are perpendicular to two of these directions and have a rhombus section in the third direction. A structure is thus obtained which is multi-(two- or three-) directional.

The cells may be closed or they may intercommunicate freely or else they may intercommunicate via non-return valves or via fuses in the form of weak zones which break on the application of heat, pressure, etc. . . .

The walls of the cells may be rigid or flexible.

When intercommunicating flexible cells are used, a flexible structure is obtained which can be inflated or deflated using air, water, or any other fluid.

The invention also relates to a method of manufacturing an element of the above type. In one implementation of the method in accordance with the invention, the structure may be made by directly assembling plane or pre-formed elements by glue, by welding, or by any other means.

In another implementation of the invention, the structure may be formed by stacking flat elements, at least some of which are suitably cut out, with the elements being glued or welded to one another along certain portions of their surfaces, and the assembly is then expanded by inserting an appropriate fluid under pressure where the cells are intercommunicating, or by developing gases or developing expansible materials in situ in the event that the cells are closed. Expansion may be triggered by any appropriate means: heat; pressure; shock; radiation, etc.

An open cell element may be used as a blank for forming a mold, and may then be destroyed by any appropriate means: dissolving, subliming, liquefying, etc. . . . The mold can then be used to make a copy of the original element and is then either retained or destroyed in turn.

Elements in accordance with the invention may be used in numerous different fields of application.

By way of non-limiting example, the following may be mentioned: buildings for industrial, strategic, agricultural, individual or collective purposes, which buildings may be antiseismic, fixed or dismountable; foundations; fixed or moving panels such as security doors for a hangar, for armor plating, floors; beams, posts, etc. . . . , transmission shafts for mechanical purposes; precision benches, slabs, supports for machines or engines or gas turbines, etc. There are applications relating to radiation-proofing, heat-proofing, and sound-proofing . . . ; to aviation and to space (fuselages, wings, control surfaces, decks, partitions); to tanks and containers for transport or confinement purposes, etc.; to biotechnolgical purposes; to shaping new materials, polymers, elastomers, glues, foams, ceramics which may be reinforce or not, special or treated alloys or metals; to computing to provide and design modular cabinets having three-dimensional elements including their own cooling circuits; to electricity; there are applications in radiation, in microwaves, in heat pumps, etc. . . .; in transport, for containers, for dirigibles, for pneumatic vessels made of inflatable structures; in the food industry for filter elements and there are other occasions making use of high pressure differences such as: reverse osmosis, ultra-filtration, and micro-filtration, either together or separately; there are applications in marine industries: offshore structures, raising existing structures, hulls, masts, pontoons, etc.; in industries concerned with improving living or working conditions, with providing sound insulating partitions, heat insulating partitions, etc. . . .

Other characteristics of the invention appear from the following description given by way of non-limiting example with reference to the accompanying drawings, showing a few embodiments and which serve to obtain a better understanding of how the invention may be implemented.

In the drawings:

FIG. 6 is a perspective view of one embodiment having three series of convex closed shell-like elements, one of which has a rhombus section;

FIG. 7 is a section showing the disposition of convex closed shell-like elements shown in FIG. 6;

FIG. 10 is a perspective view of a tubular element obtained by folding, which permits the achievement of a structure according to the invention;

FIG. 10A shows the tubular element of FIG. 10 in the course of folding;

FIG. 10B illustrate the folding mode used for making the tubular element of FIG. 10;

FIG. 13, 13A and 13B are perspective views of pieces, the assembly of which leads to a structure according to FIG. 4 or 6;

Figure 4:
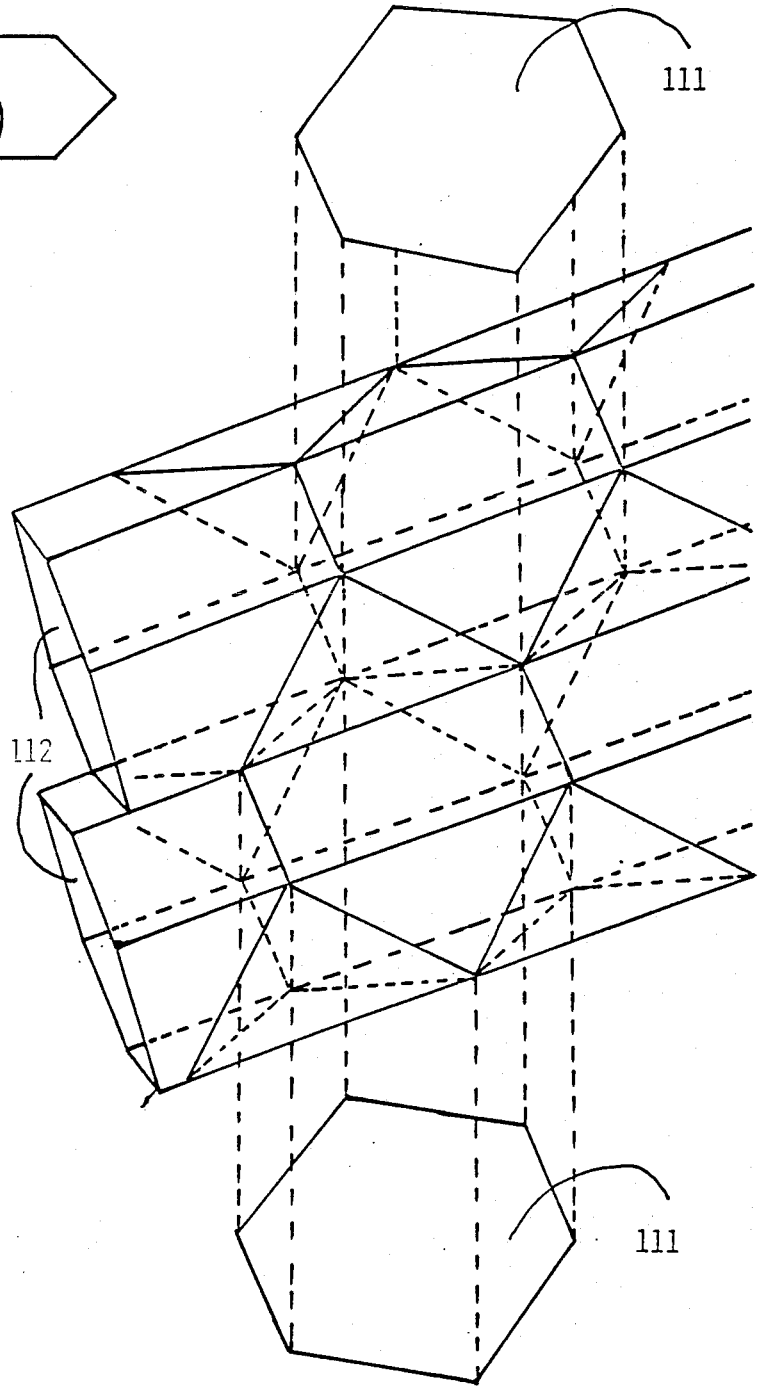
FIG. 4 is a perspective view of one embodiment represented by two series of hexagonal cross-section convex closed prismatic shells; intersecting at a right angle.
Figure 18:
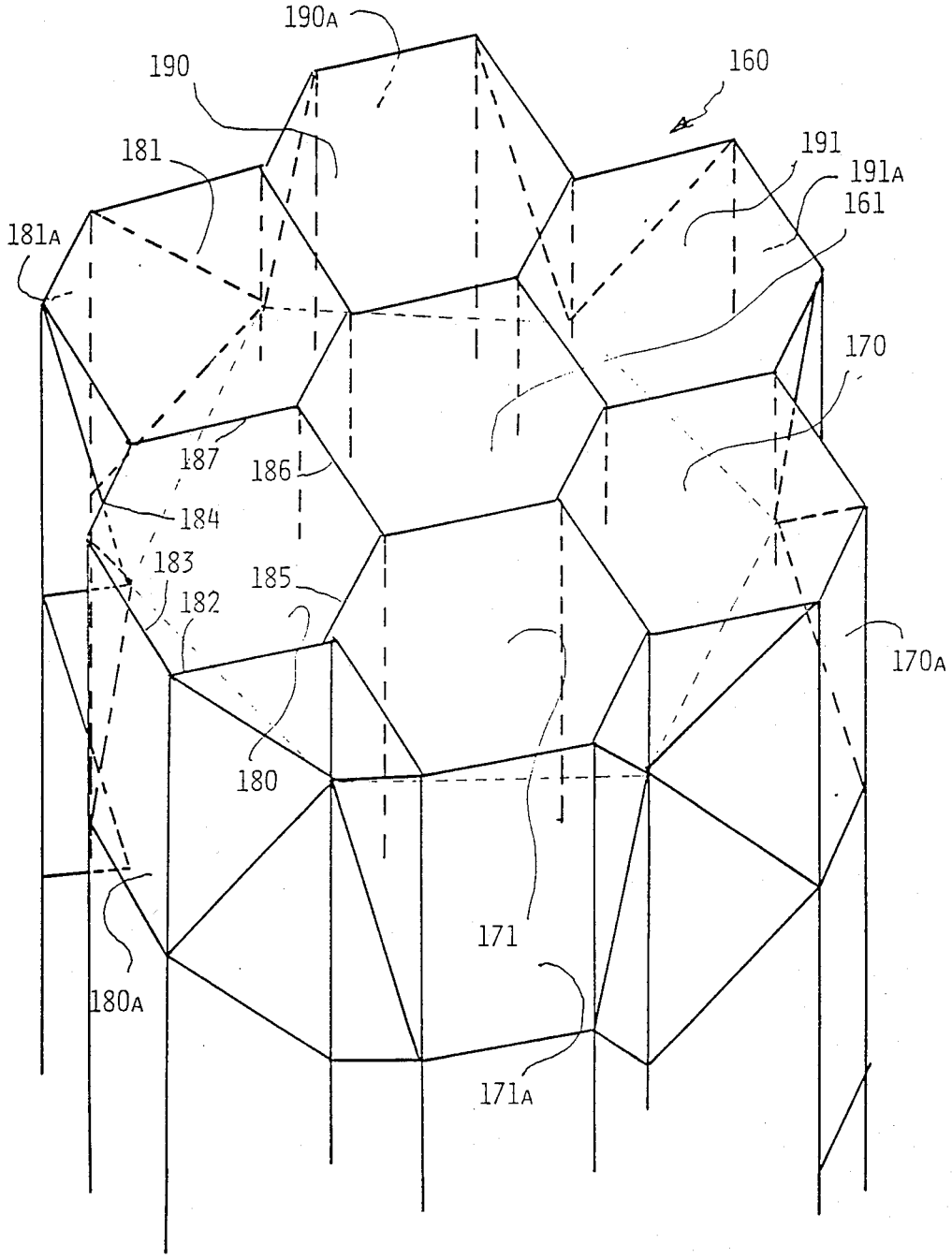
Figure 19:
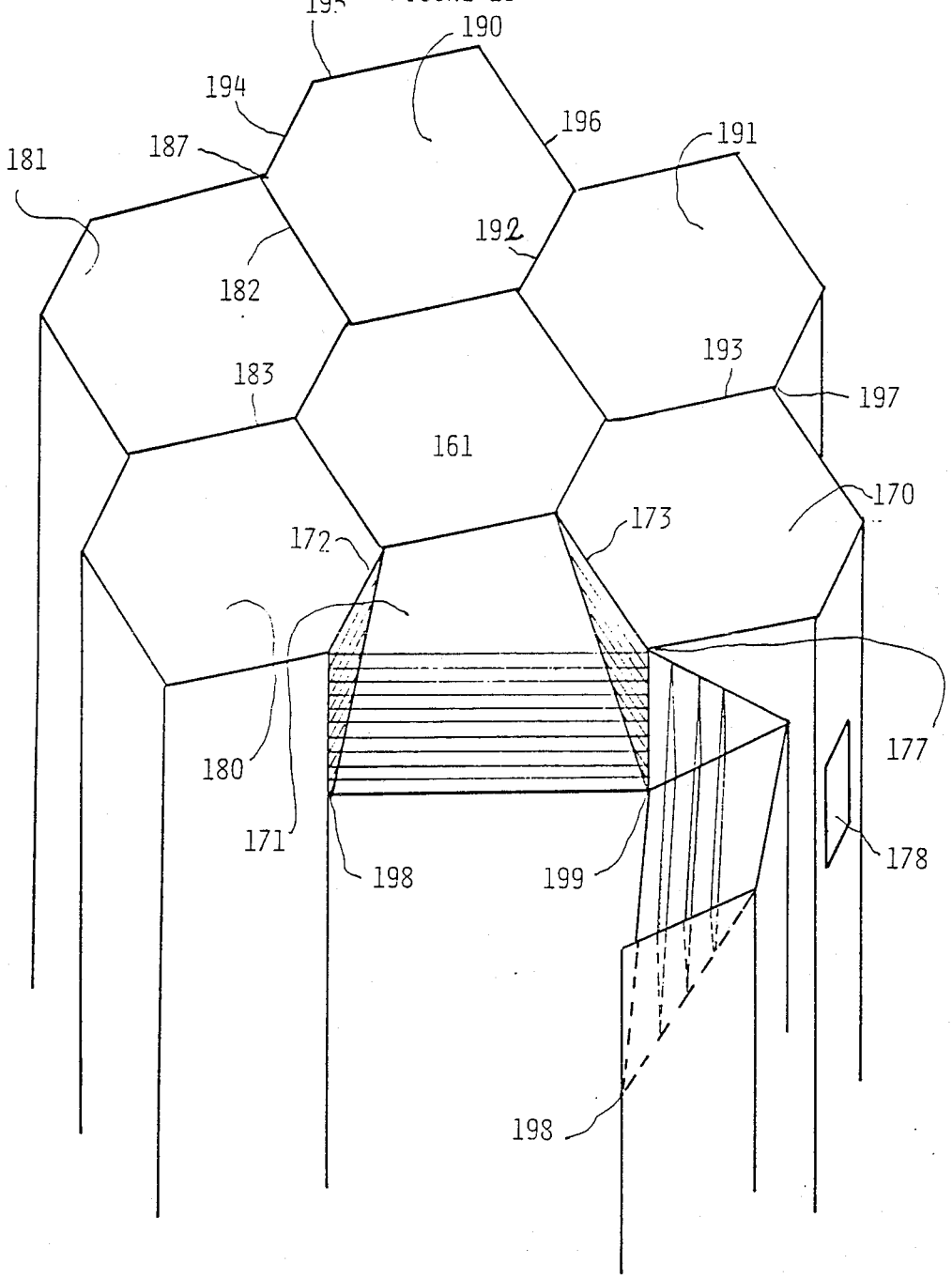
Figure 20:
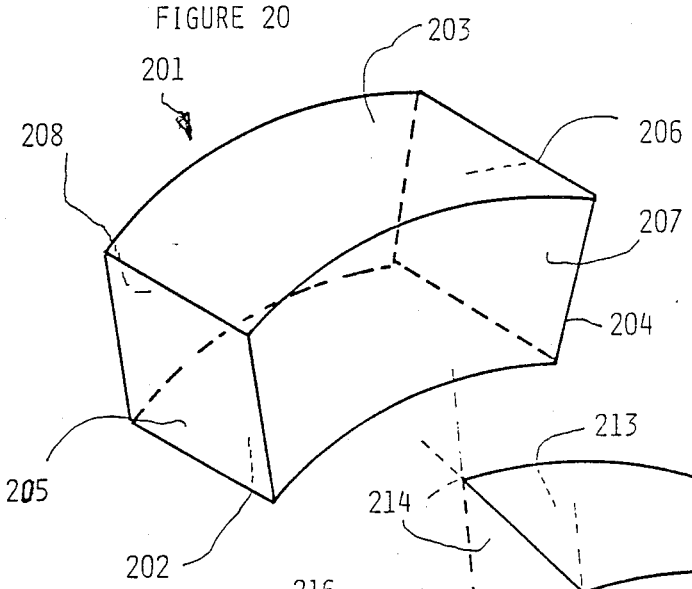
Figure 21:
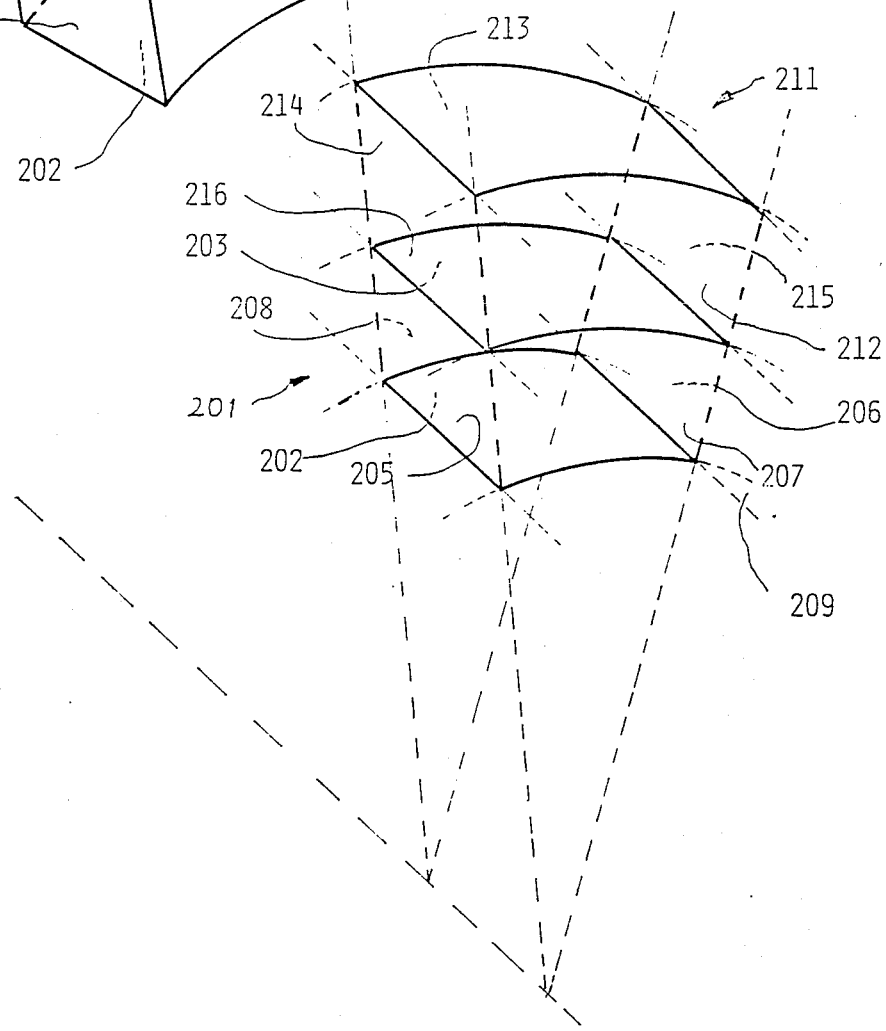
Figure 22:
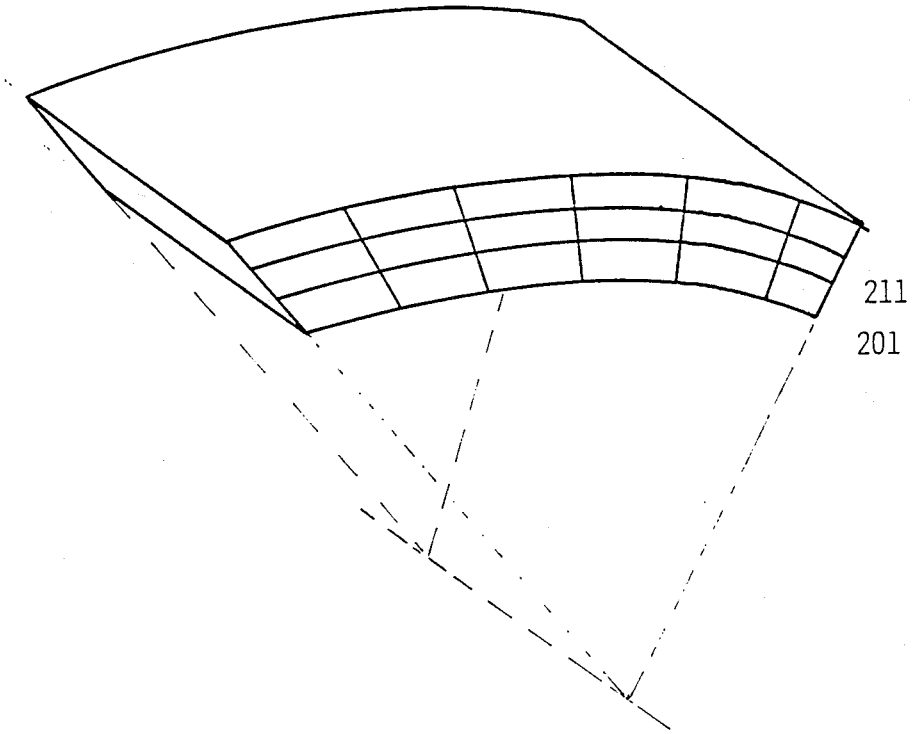
Figure 23:
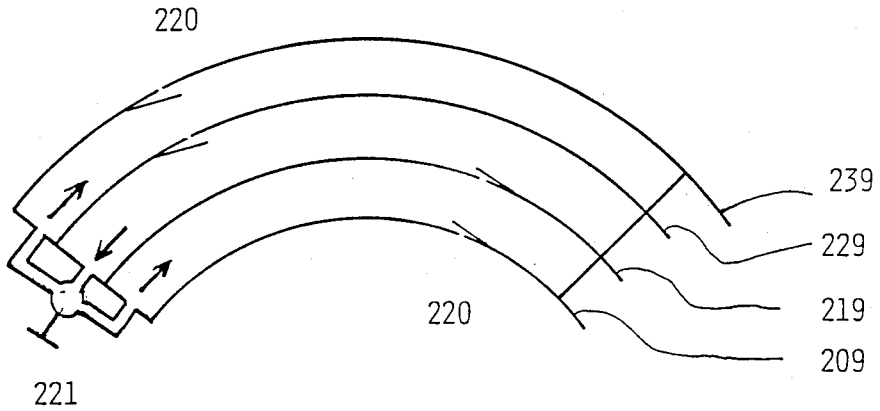
Figure 24:
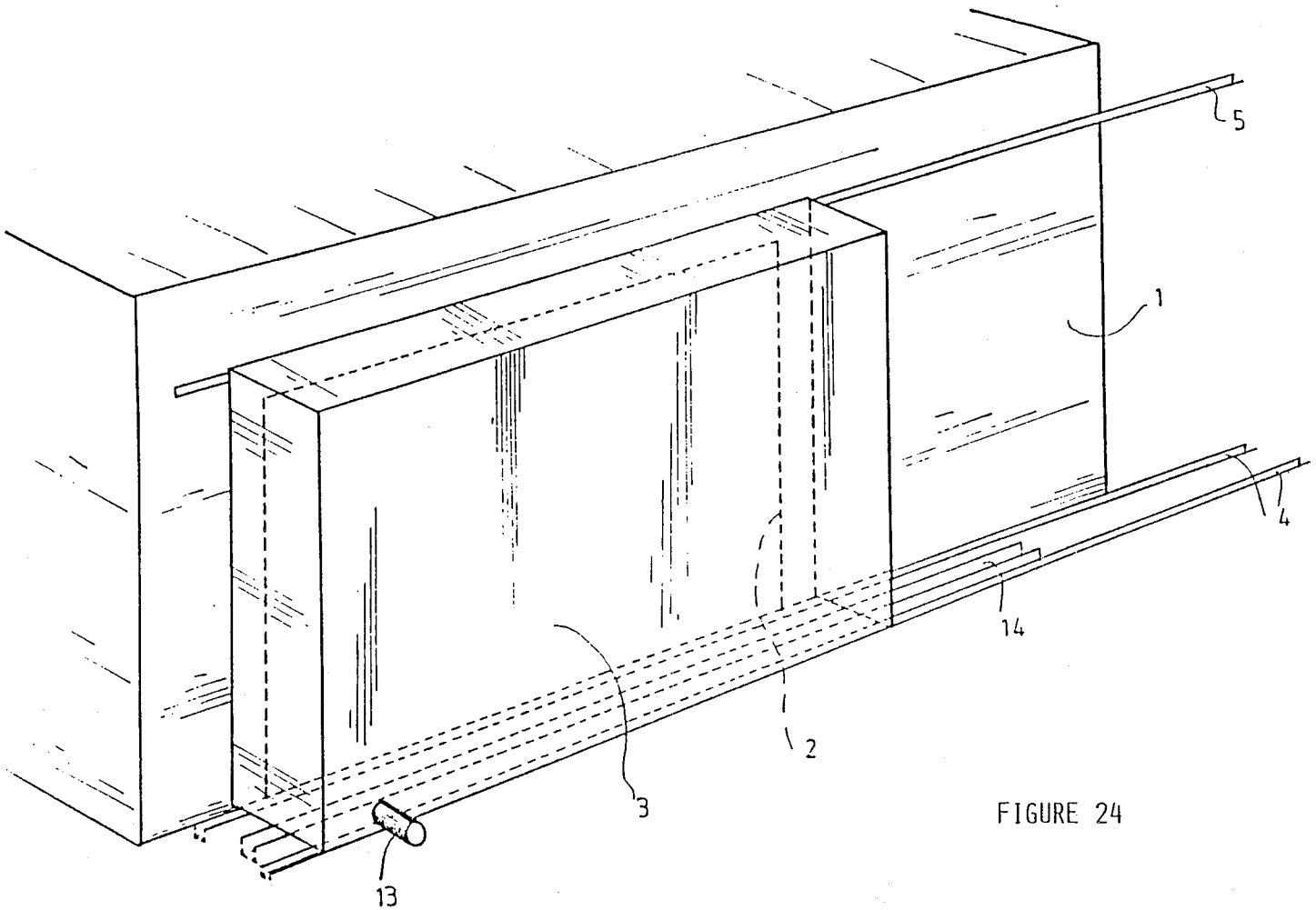
Figure 26:
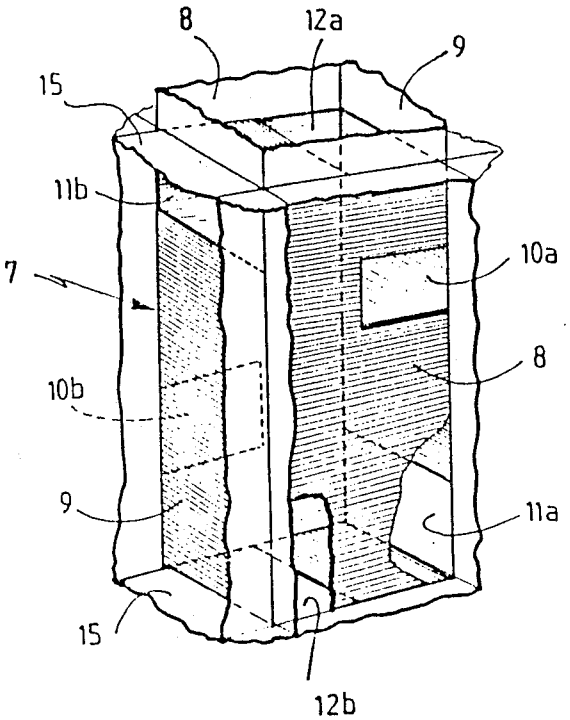
Figure 25:
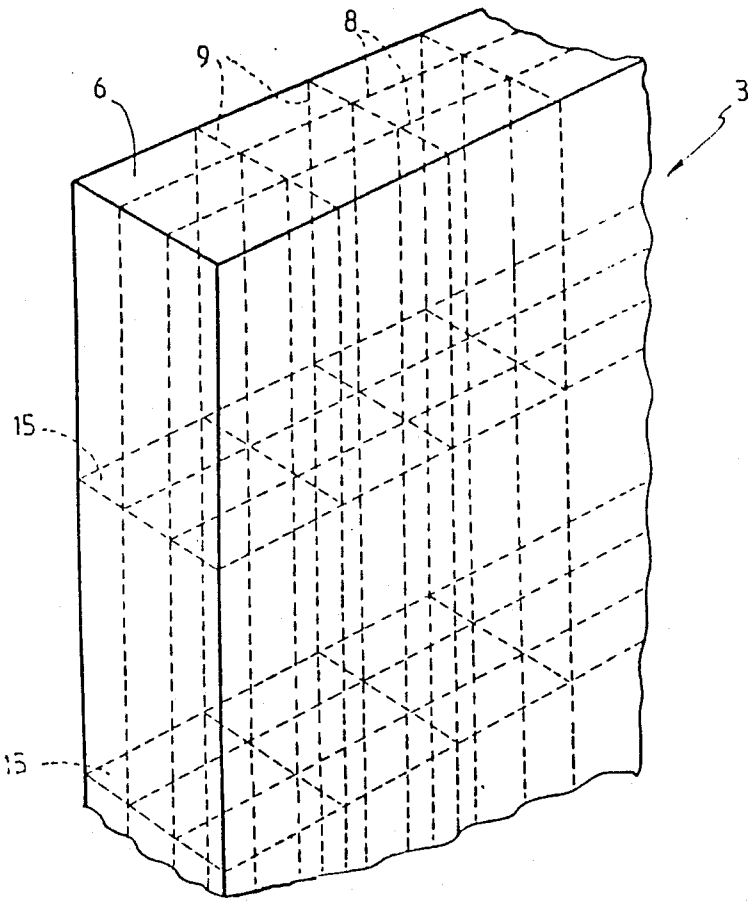
Figure 29:
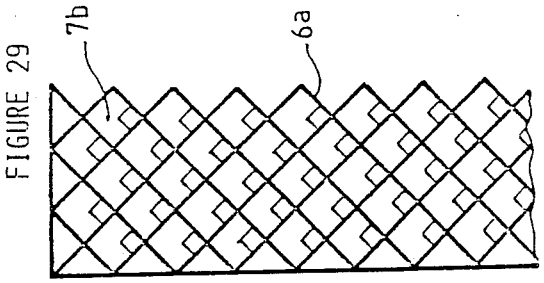
Figure 28:
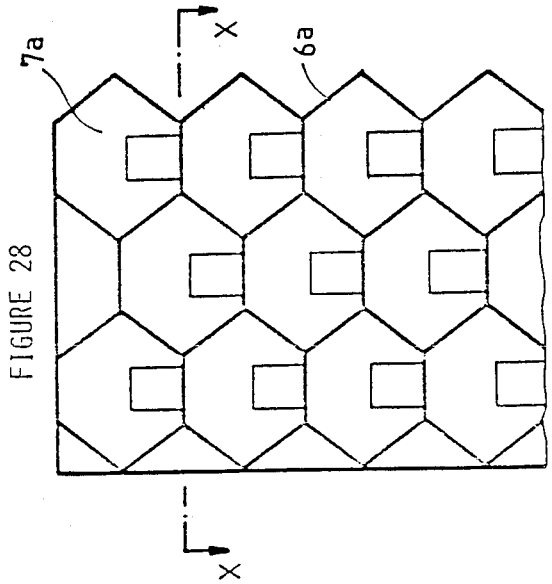
Figure 27:
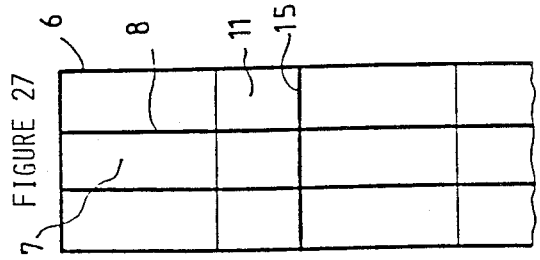
Figure 30:
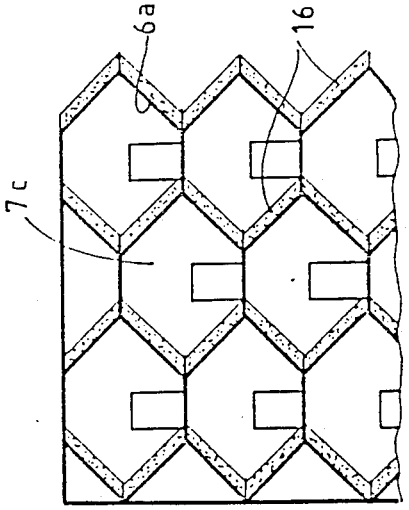
Figure 32:
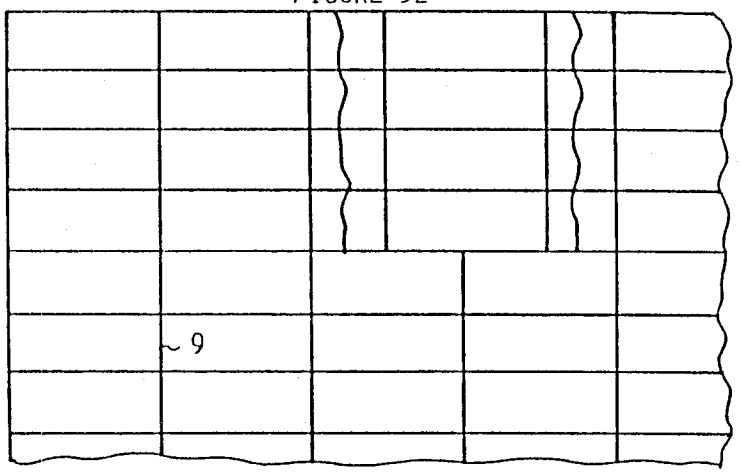
Figure 33:
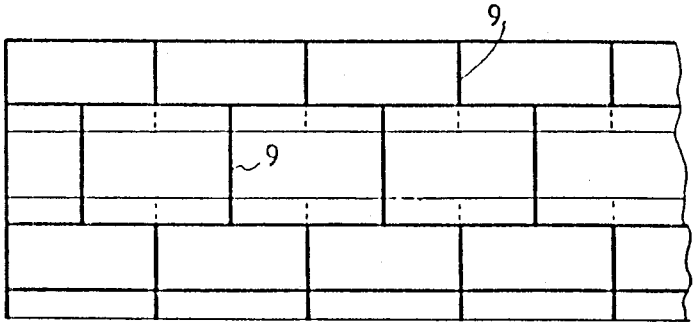
Figure 31:
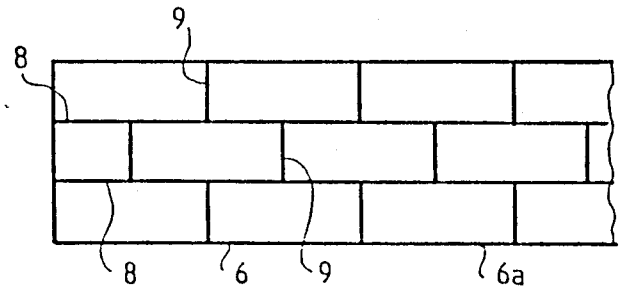
Figure 34:
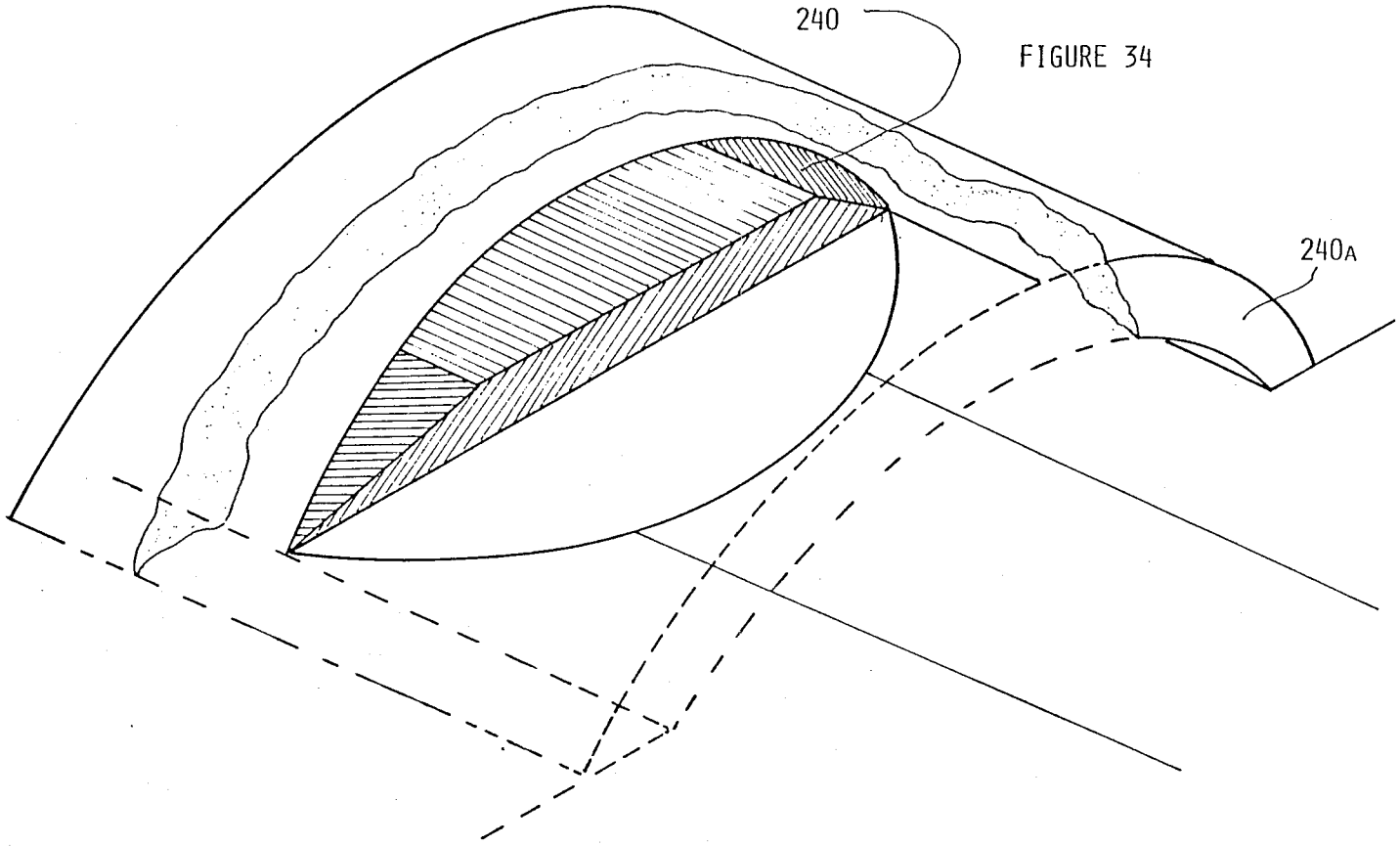
Figure 35:
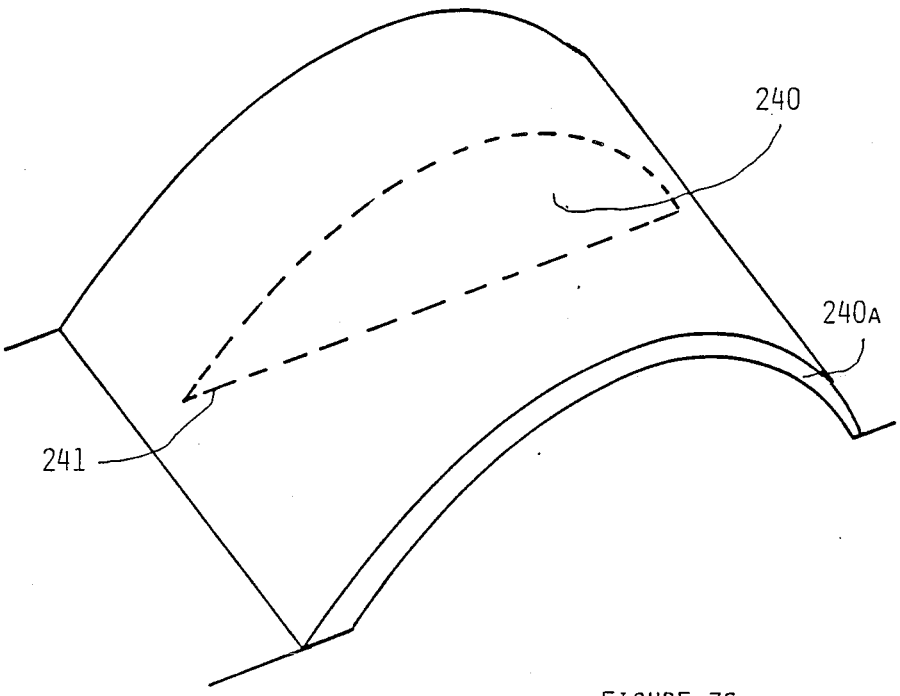
Figure 36:
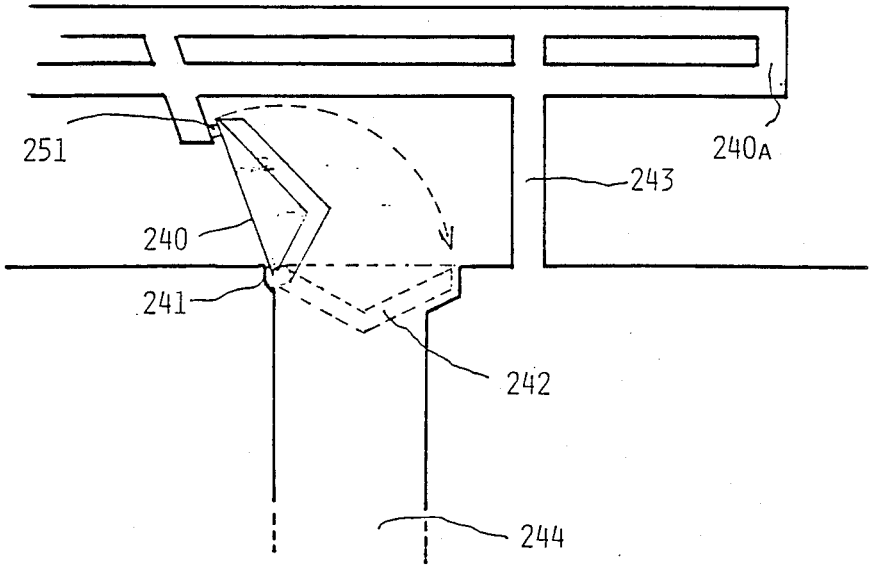
Figure 37:
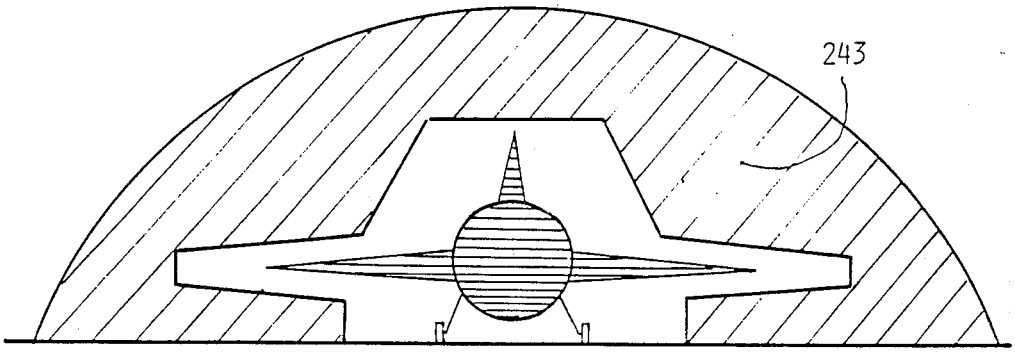
Figure 38:
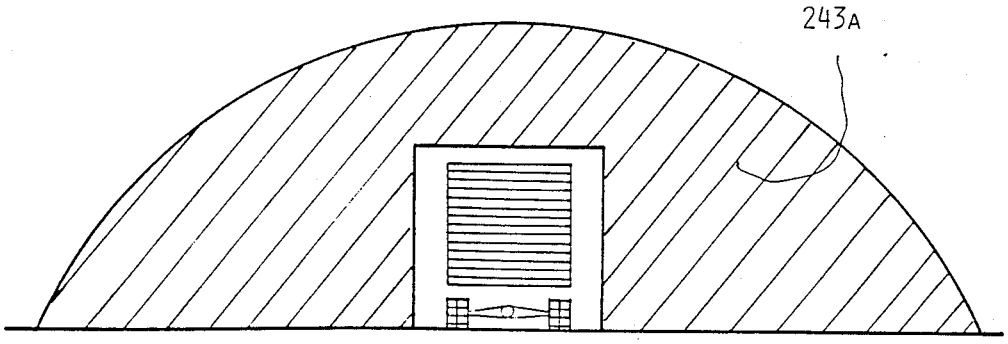
Figure 39:
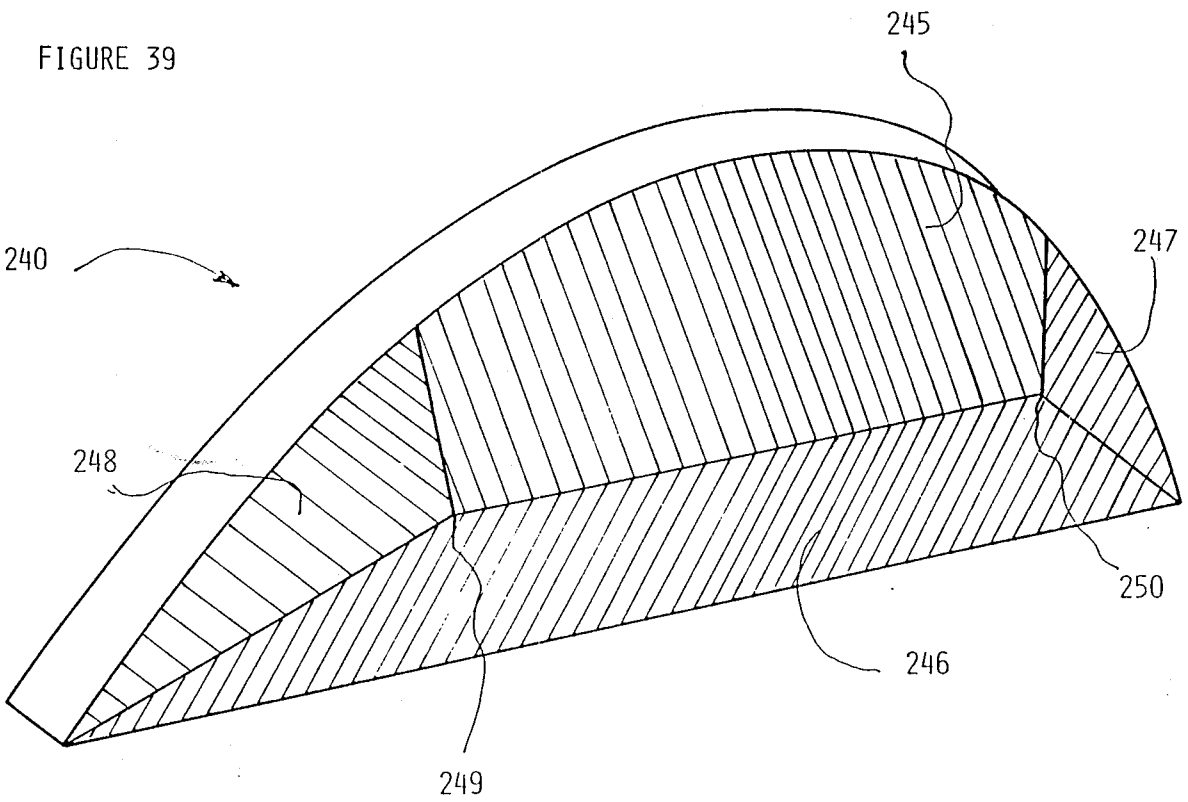
Figure 40:
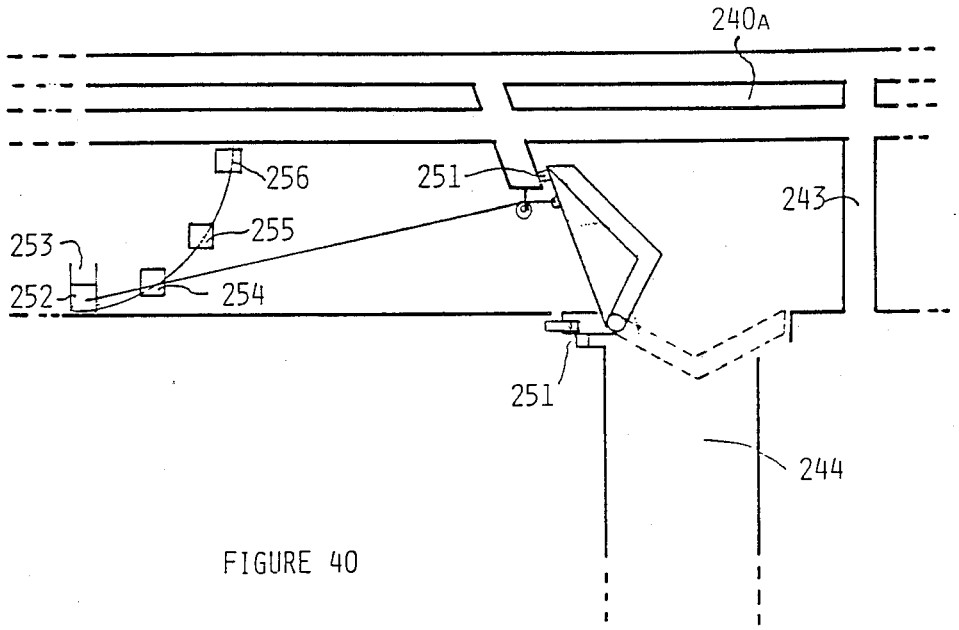
Figure 41:
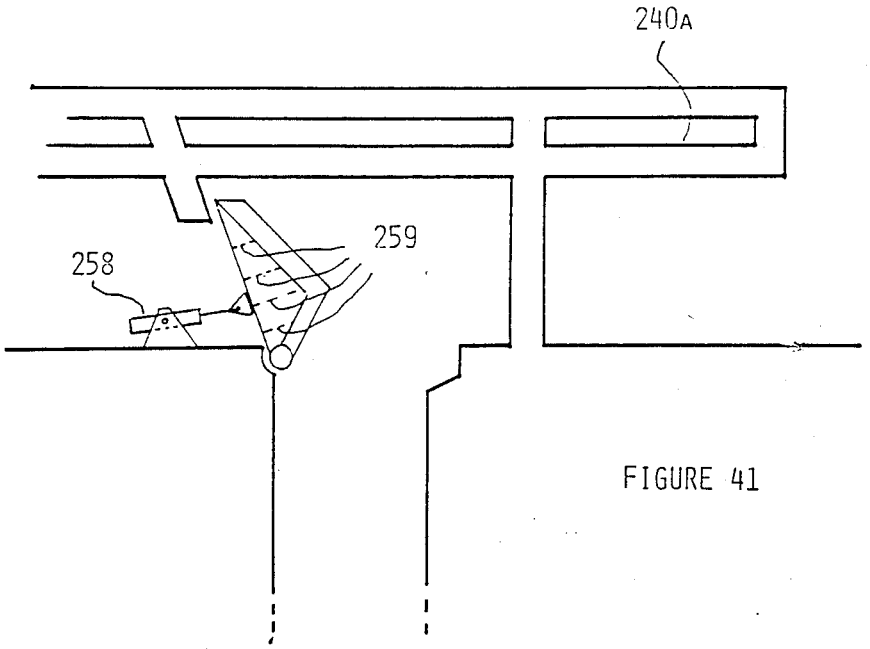
Figure 42:
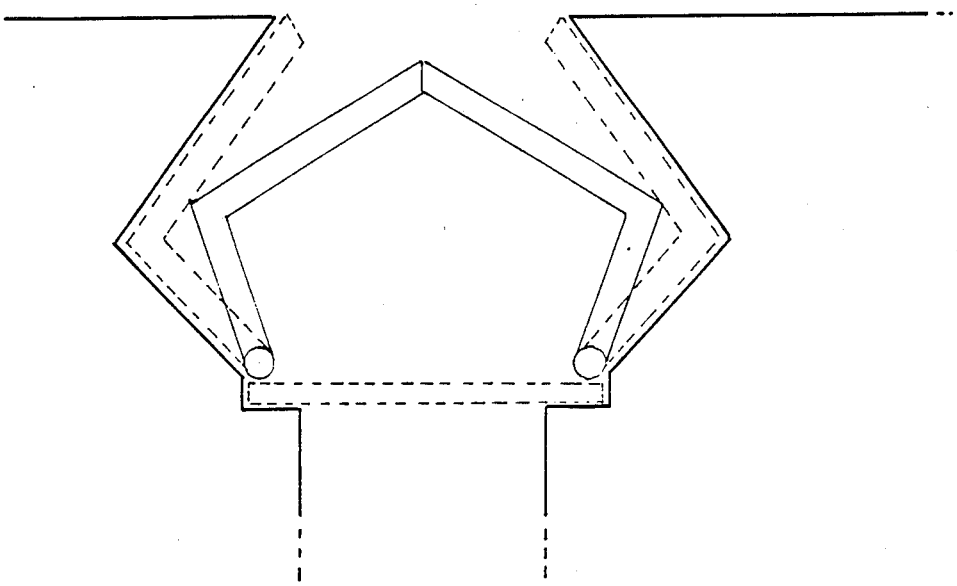
Figure 43:
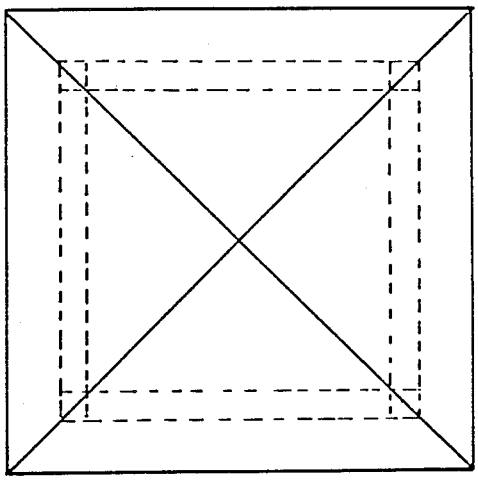
Figure 44:
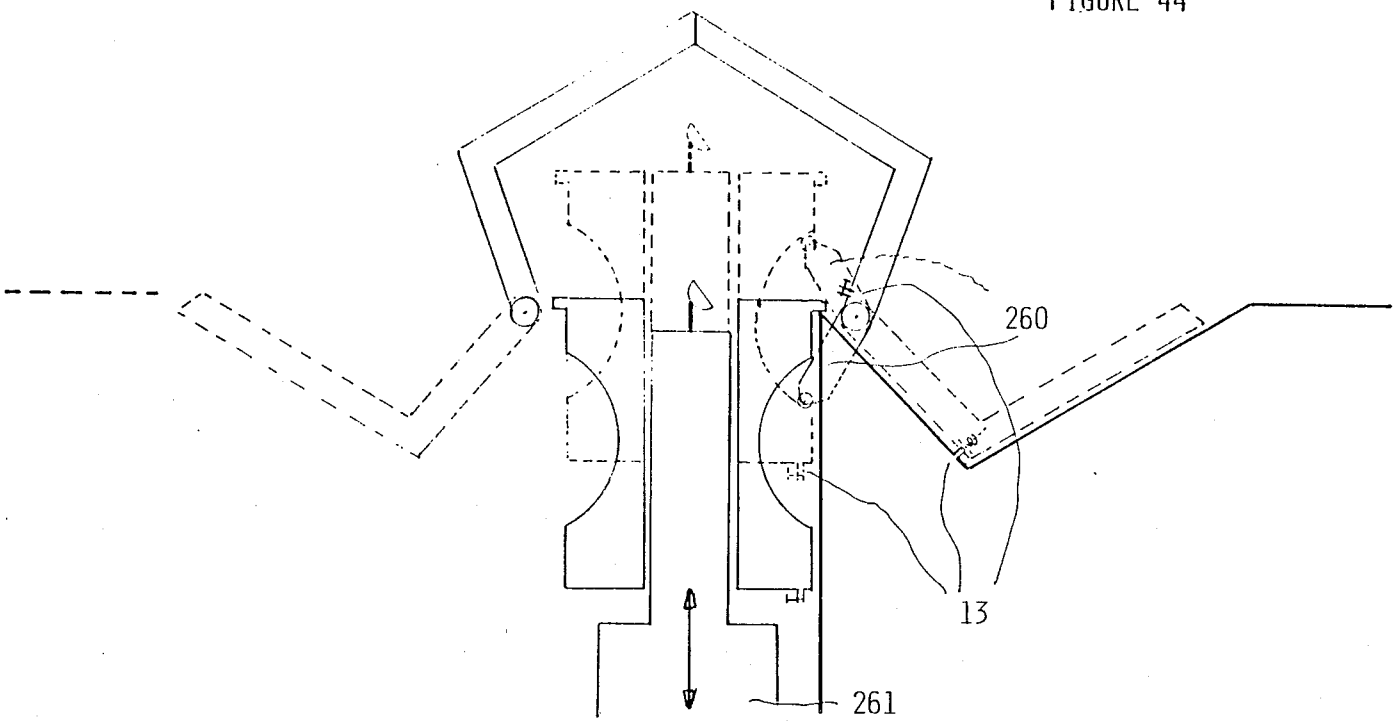
Figure 45:
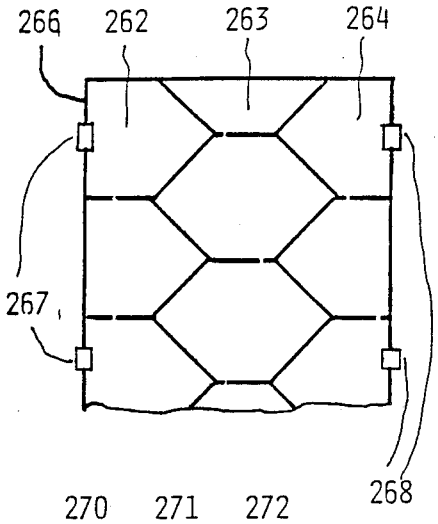
Figure 46:
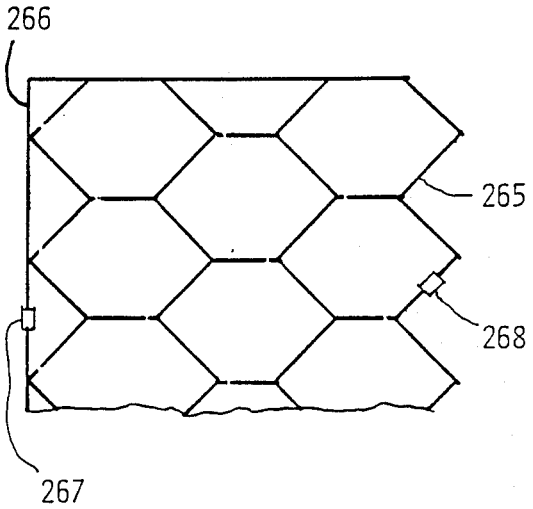
Figure 47:
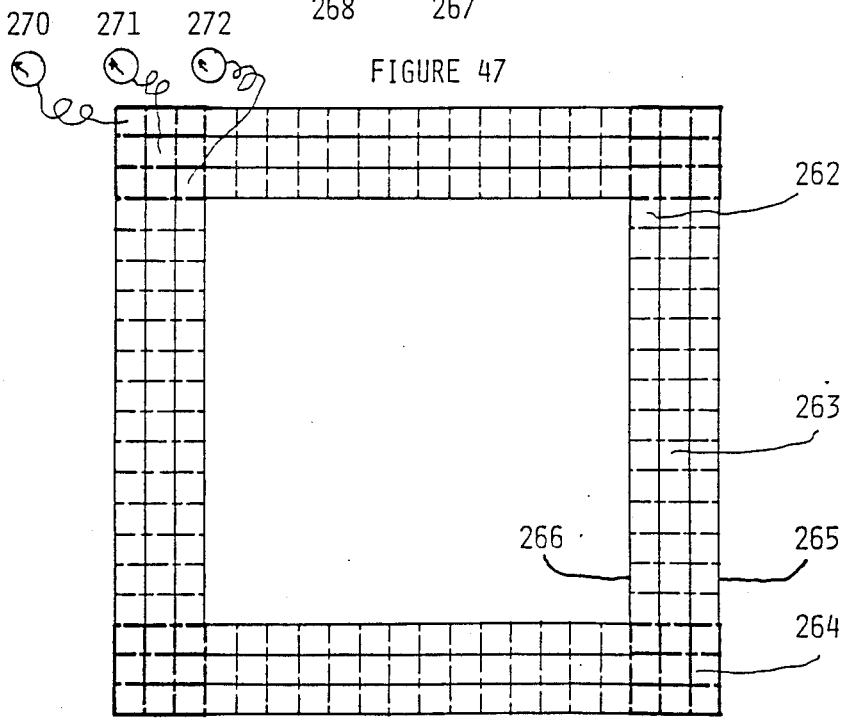
Figure 48:
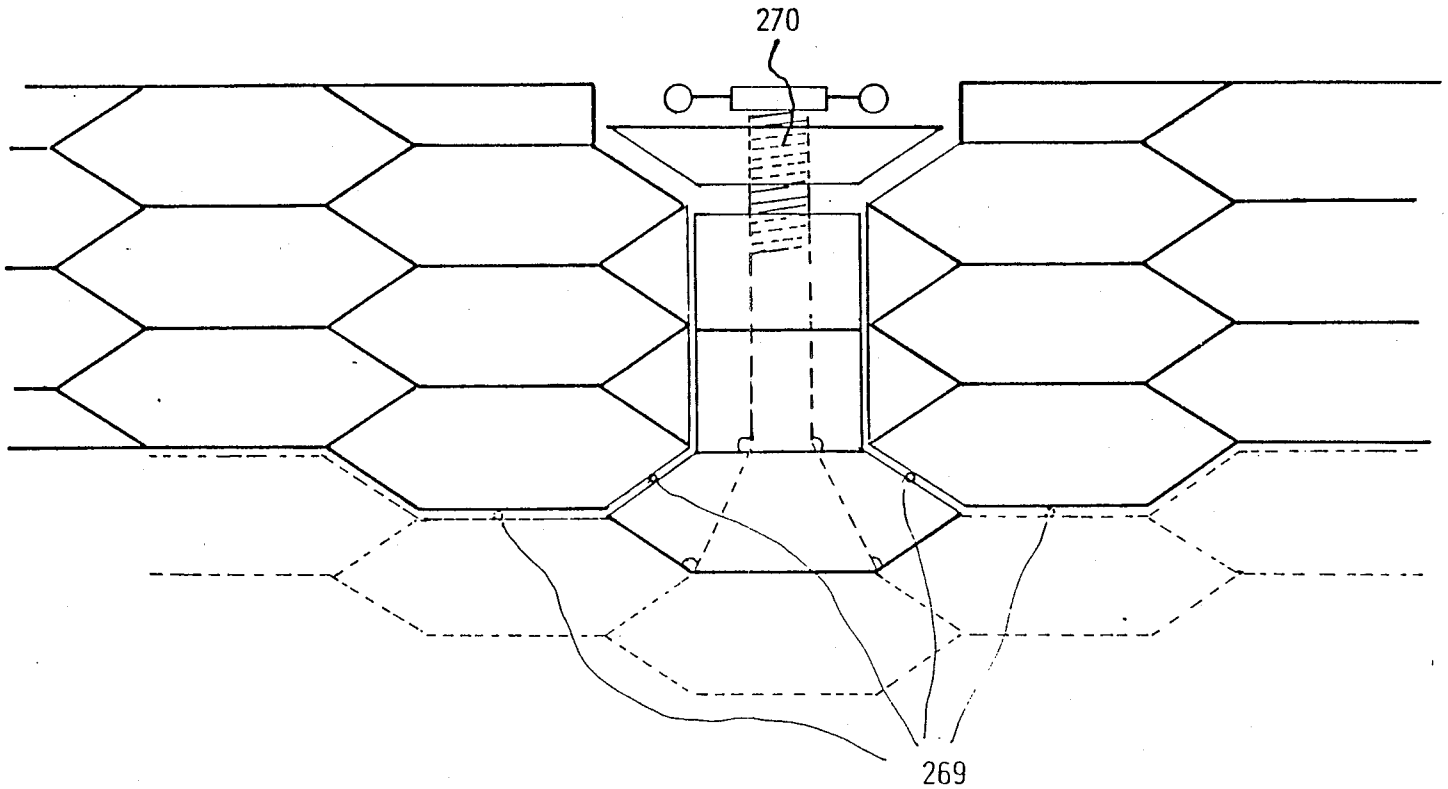

FIGS. 14, 15, 16, and 17 are views showing a method of manufacturing an element as shown in FIG. 4;

FIG. 18 is a perspective view of a first embodiment of a tubular element capable of serving as a post, a mast, a transmission shaft, etc.;

FIG. 19 is a perspective view of an embodiment of the invention for use as a thermostatically controlled electronics cabinet;

FIG. 20 is a perspective view of a cell constituting a portion of an annular element;

FIG. 21 is a perspective view showing how cells may be assembled to constitute an annular vault;

FIG. 22 is a perspective overall view of an assembly such as that shown in FIG. 21 and comprising multiple layers;

FIG. 23 is a section through one of the ways in which layers of the convex closed shell-like elements may be caused to intercommunicate;

FIG. 24 is a perspective view of a building including a door comprising an element in accordance with the invention;

FIG. 25 is a perspective view of a detail of the door;

FIG. 26 is a perspective view of a cell in the door;

FIG. 27 is a vertical cross-section through a portion of the FIG. 25 door;

FIGS. 28 to 30 are views similar to FIG. 27 showing other embodiments;

FIG. 31 is a horizontal section showing a variant embodiment of FIG. 25;

FIG. 32 is a front view of a portion of the door shown in FIG. 31 and partially cut away;

FIG. 33 is a horizontal section on line x-x of FIG. 28;

FIG. 34 is a perspective view of a vault which is partially cut away and including a door in accordance with the invention;

FIG. 35 is a perspective view showing the disposition of the door under the vault;

FIG. 36 is a section through the door in accordance with the invention and showing its disposition under the vault;

FIG. 37 is a front view of a bulwark shown in FIG. 36;

FIG. 38 is a front view of another way of providing a bulwark as shown in FIG. 36;

FIG. 39 is a perspective view of a door in accordance with the invention and constituted by inclined planes;

FIG. 40 is a section through a door under a vault and in accordance with the invention, using its variable inertia for opening and closing purposes;

FIG. 41 is a section through a door which is moved by actuator means;

FIG. 42 is a vertical section through two of the four portions of an opening in accordance with the invention and as shown in FIG. 43;

FIG. 43 is a horizontal section through four assembled elements as shown in FIG. 42;

FIG. 44 is a section through an opening in accordance with the invention situated at ground level;

FIG. 45 is a fragmentary section through a stack of juxtaposed convex closed shell-like elements consisting partitions in accordance with the invention;

FIG. 46 shows a disposition similar to FIG. 45 but having a surface constituted by sloping planes in accordance with the invention;

FIG. 47 is a vertical section through a container on the middle of its longitudinal axis; and FIG. 48 is a vertical section through a disposition providing access to an assembly of a plurality of volumes in accordance with the invention.

Figure 1:
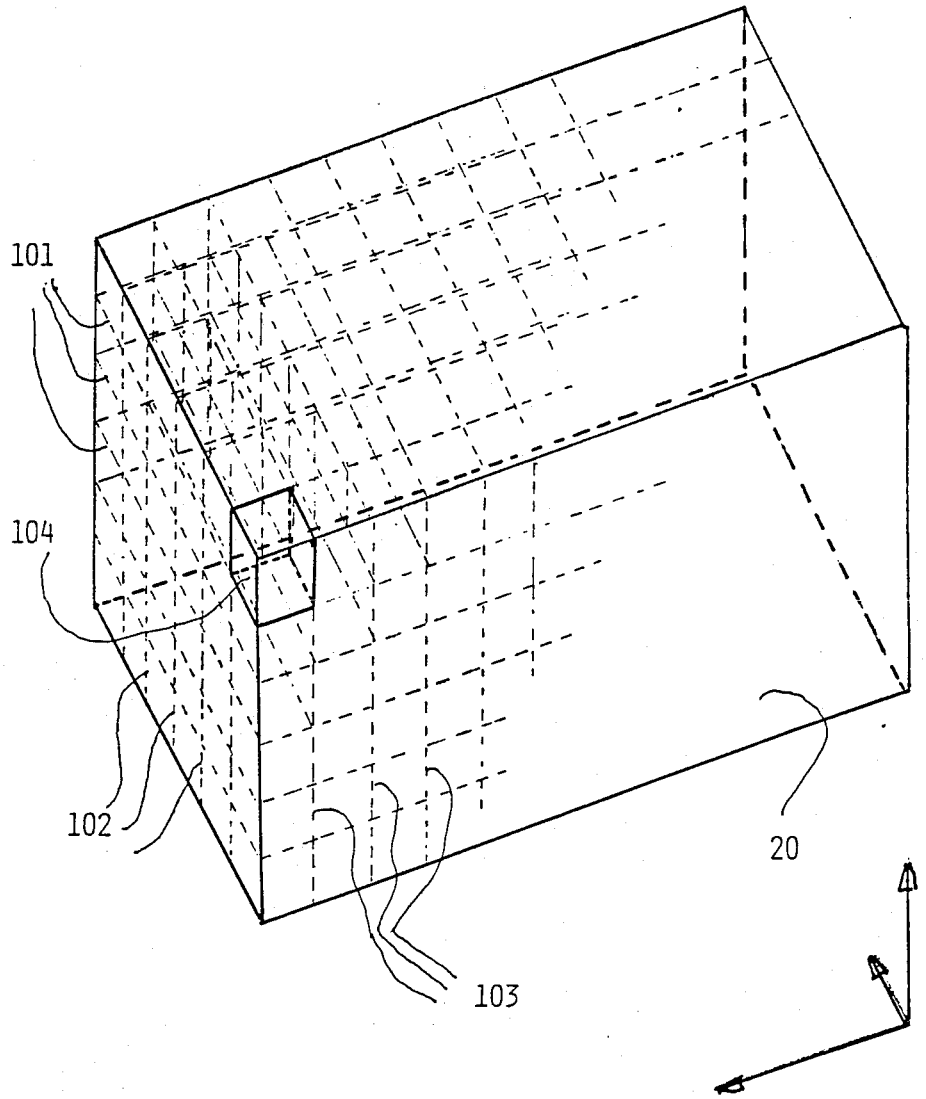
FIG. 1 is a perspective view of an element in accordance with a first embodiment of the invention, which element is assumed to be transparent in order to show its internal structure.

A element 20 shown in FIG. 1 is constituted by cells which are delimited by three series of planes: horizontal planes 101, vertical planes 102, and vertical planes 103 which are perpendicular to the planes 102. One of the cells, 104, is picked out in heavy lines. The cells are parallelepipeds and their faces may be identical (in which case they are cubes) or different. As explained below, the cells may be closed or they may intercommunicate freely with one another or they may intercommunicate via non-return valves or via fuses constituted by zones which break on application of heat, or of pressure, or of a chemical substance, etc. . . . , or of a combination of several of these zone-breaking means.

Figure 2:
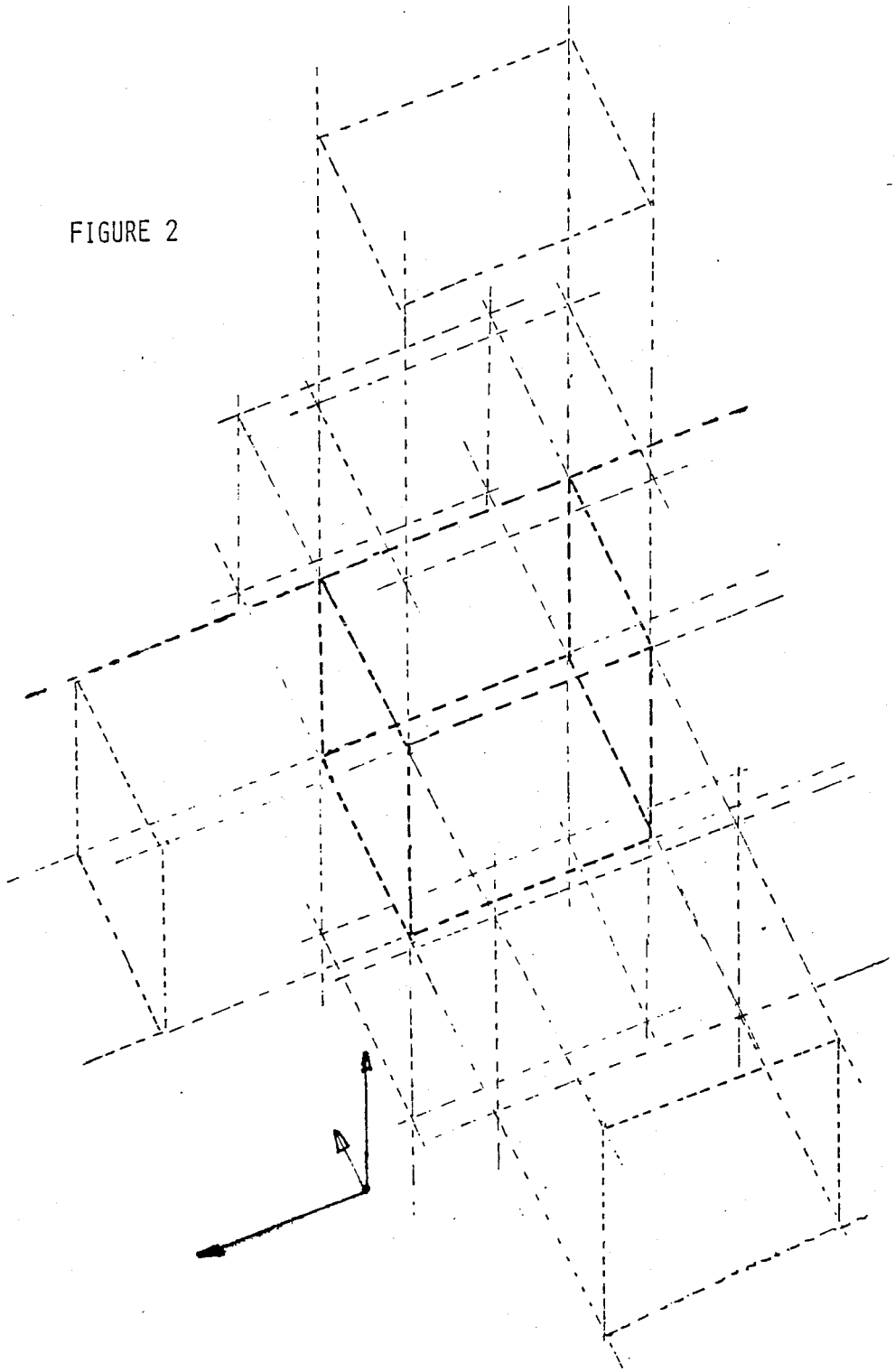
FIG. 2 is a perspective view of one of the closed central cells constituting the volume shown in FIG. 1.
Figure 3:
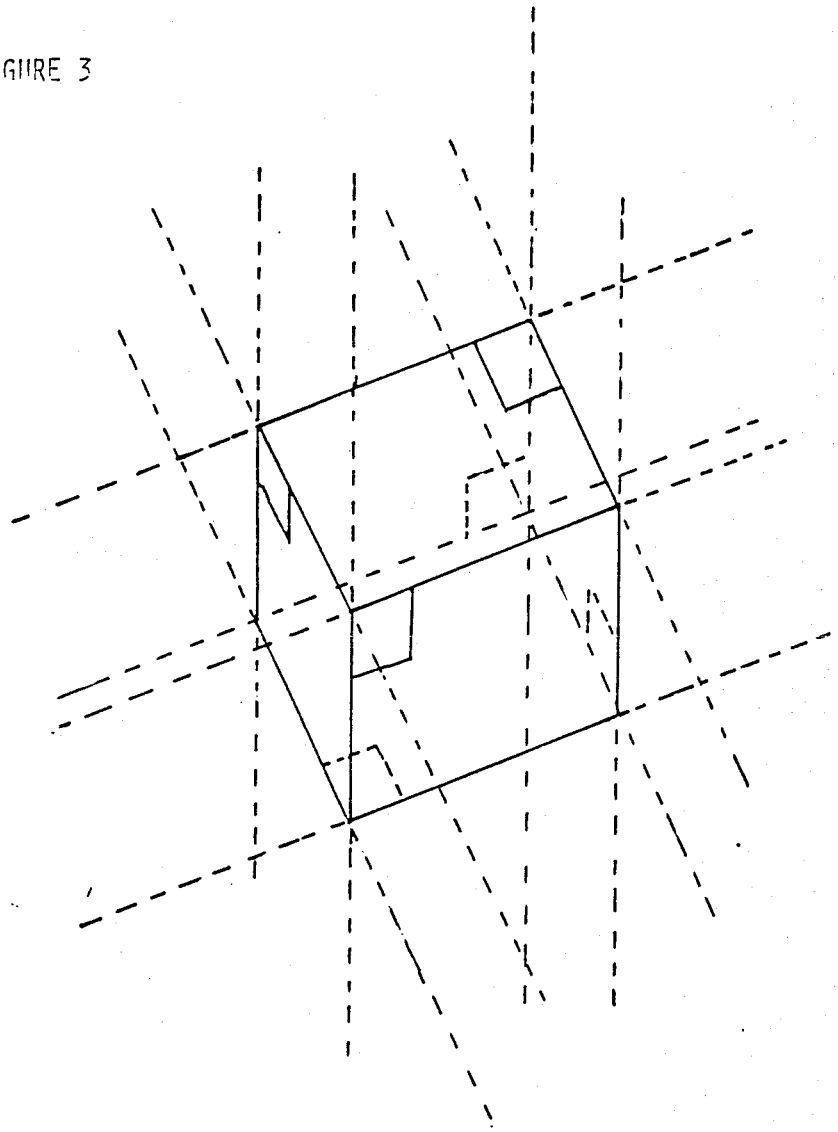
FIG. 3 shows a cell identical to the FIG. 2 cell, but including openings.

An element 20 as shown in FIG. 1 is constituted either by closed cells as shown in FIG. 2 or else by cells which communicate with one another via openings disposed to constitute baffles, as shown in FIG. 3.

Figure 5:
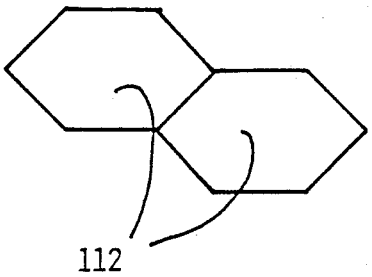
FIG. 5 is a section showing the disposition of the corner closed shell-like elements shown in FIG. 4.

In the embodiment shown in FIG. 4, which is based on the pattern shown in FIG. 5, the cells are defined by the intersections between convex closed shell-like elements of polygonal section. These cylinders include vertical hexagonal cylinders 111 and horizontal hexagonal cylinders 112. The hexagons are regular and they are all the same size. The convex closed shell-like elements parallel to a given direction are juxtaposed and each of them shares one of its walls in common with one of the adjacent closed shell-like elements. Such an element is particularly strong, at least in the two directions in which the shell-like element axes extend.

Figure 8:
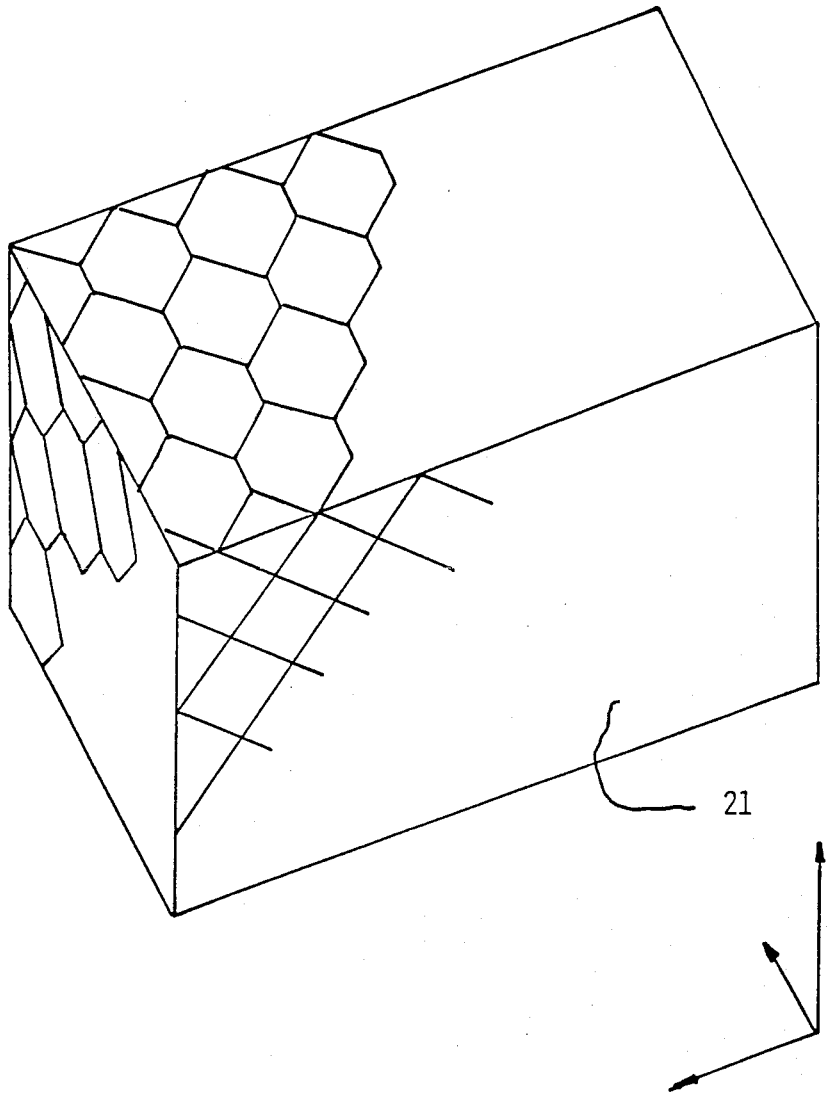
FIG. 8 is a perspective view of a volume obtained by a method such as that shown in FIG. 6.

As shown in FIG. 6, which is based on the pattern shown in FIG. 7, the two directions of shell-like element axes, namely vertical for the closed shell-like elements 111 and horizontal for the cylinders 112, are further intersected in a third direction by rhombus section cylinders 113, such an element is particularly strong in the three directions of the convex closed shell-like elements axes when forming a volume 21 as shown in FIG. 8.

Figure 9:
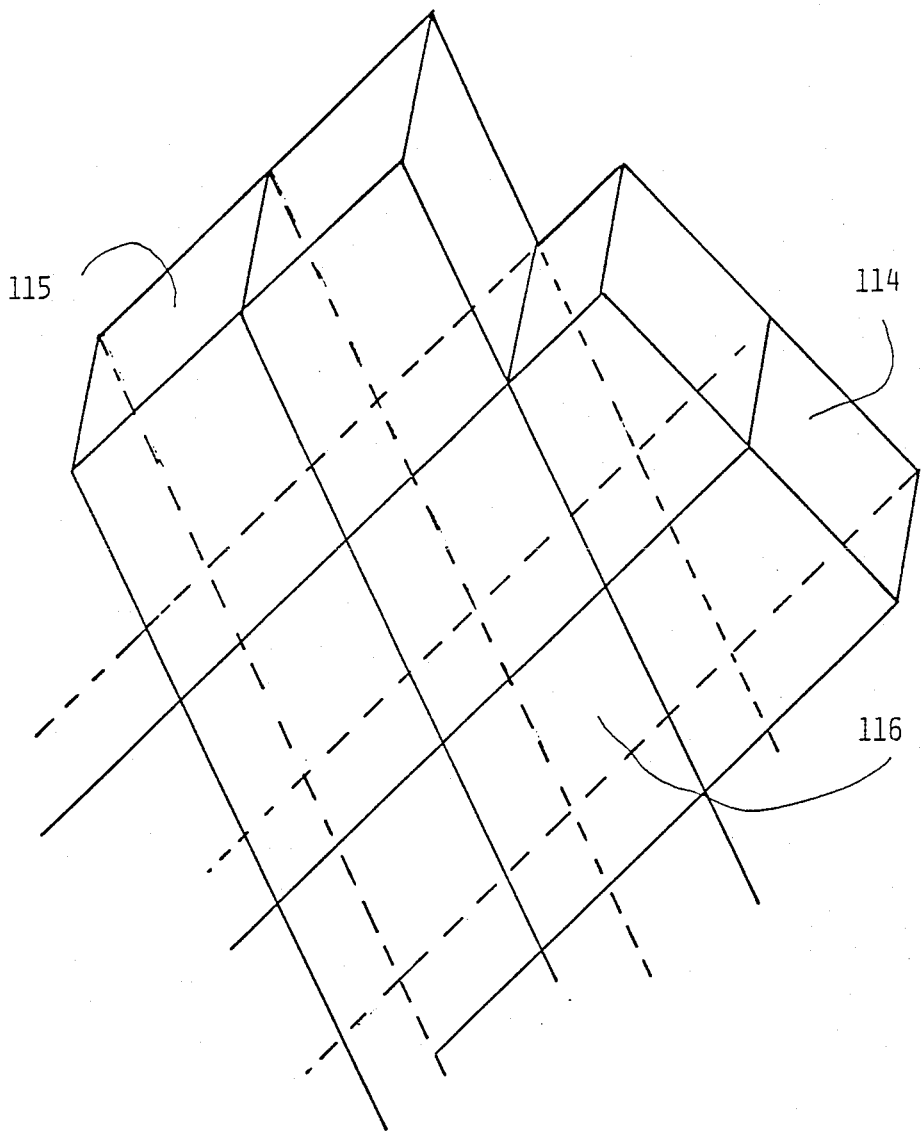
FIG. 9 is a perspective view of two series of cylinders intersecting at any angle and a series of the convex closed shell-like elements perpendicular to the plane formed by by the first two series.

As shown in FIG. 9, two series of cylinders 114 and 115 of rectangular section intersect at some angle in a plane, thereby forming convex closed shell-like elements 116 extending perpendicularly to said plane, with the convex closed shell-like elements 116 being rhombus-section if the cylinders 114 and 115 are equal, and parallelogram in section if the cylinders 114 and 115 are not equal.

A series of parallelogram section convex closed shell-like elements may intersect another series of same section convex closed shell-like elements in a common plane and at any angle, thereby determining a further series of parallelogram section convex closed shell-like elements at their intersections, with said further series of convex closed shell-like elements having axes that are not perpendicular to the plane formed by the first two series of cylinders.

All of these elements, and combinations thereof, as described above and as shown in the drawings may be made of flexible or of rigid material. If they are made of rigid material, they may be constituted by assembling cutout items, which may be plane or pre-shaped, and then fixing them together by any appropriate means, including gluing, vibration welding, lasers, electron beams, etc., or the like.

A combined mode is possible including both rigid portions and flexible portions, in which case techniques of inflation or expansion may also be used.

Figure 11:
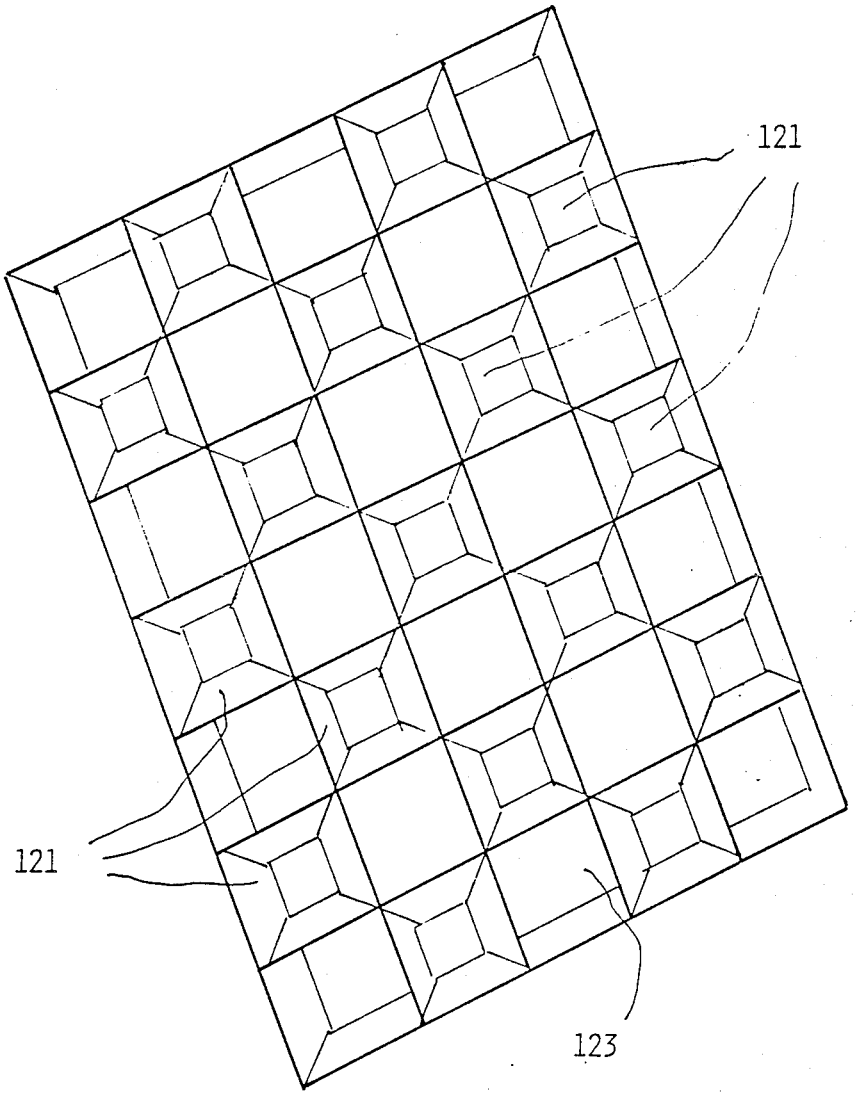
FIG. 11 shows a disposition of tubular elements which are folded and fixed on a sheet.
Figure 12:
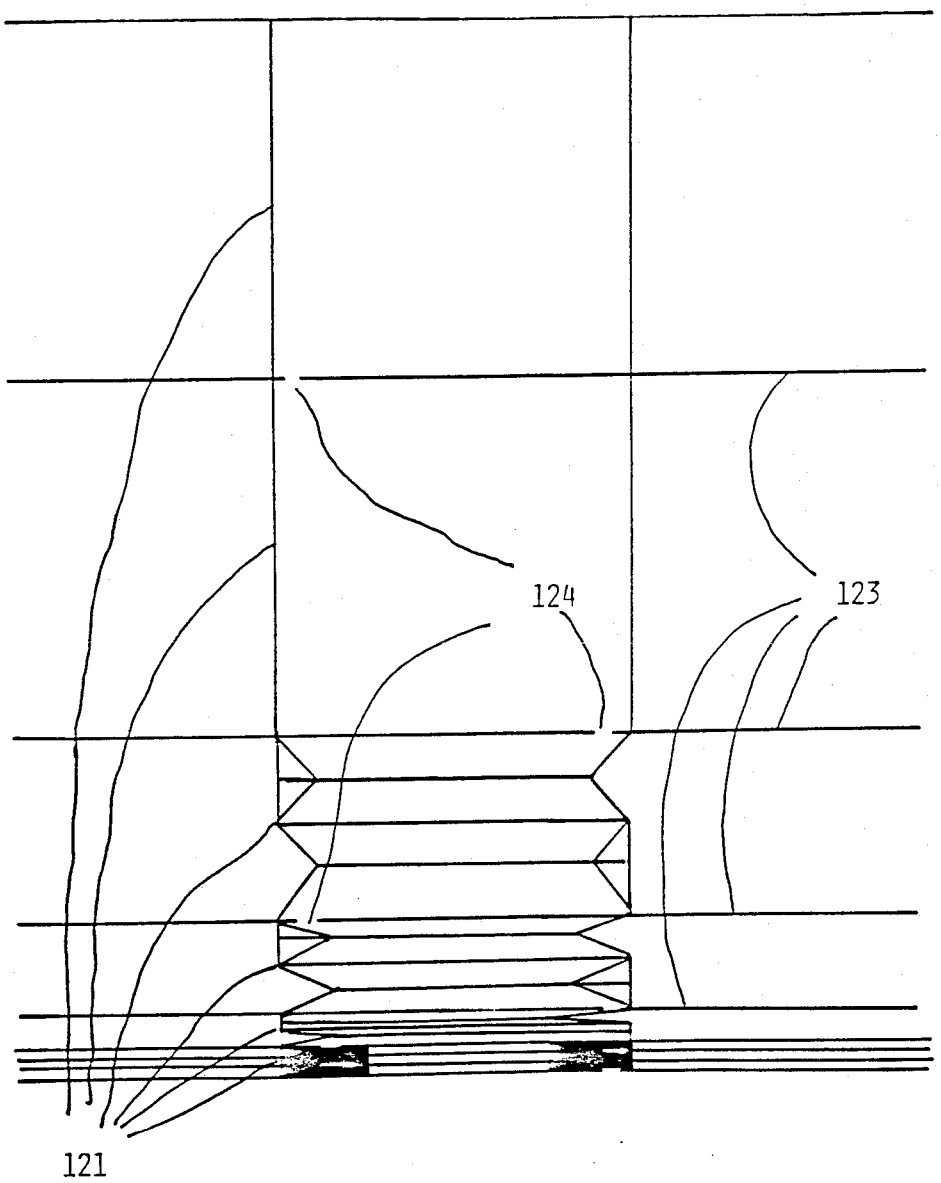
FIG. 12 is a section through an implementation in accordance with FIG. 1 while being inflated.
Figure 14:
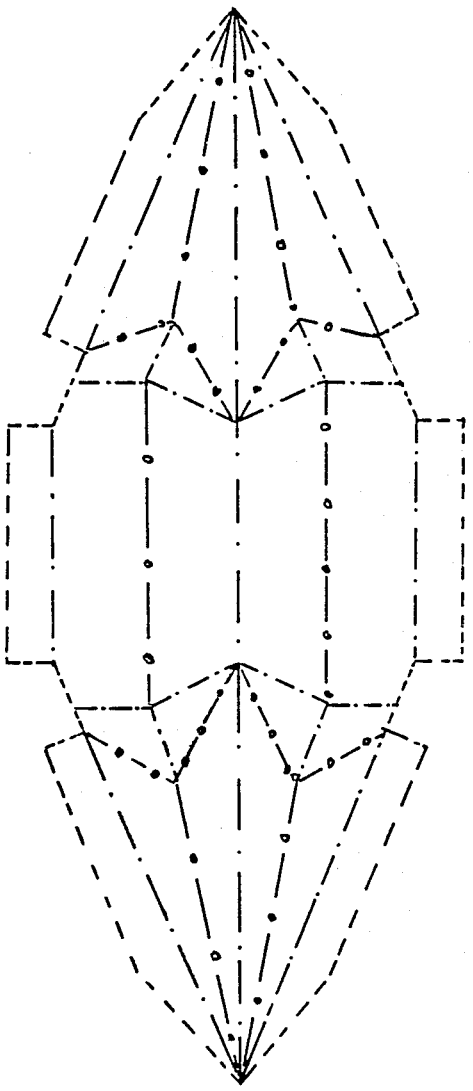
Figure 15:
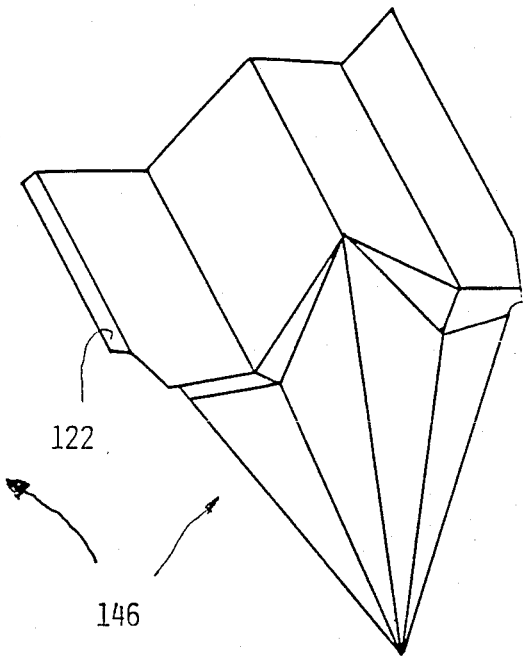

FIGS. 10 to 12 show one implementation of flexible inter-communicating cells made by inflation of a fluid under pressure. Tubular elements 121 (FIG. 10) are made of rectangular section and they are folded in a known manner by a forward fold along the dot-dash lines, by a backward fold along the circle-dash lines (FIG. 10B), and shown partially folded in FIG. 10A, to be flattened in the axial direction of the tube while providing rims 122 at each end of the tube and extending perpendicularly to the tube axis. The bottom ends of flattened tubular elements 121 are fixed on a sheet 123 (Figure 11). The bottom face of another sheet is fixed to the top portions of the elements 121, followed by another layer of flattened tubular elements 121, then another sheet, and so on until the number corresponds to the desired volume. The assembly is then expanded via the orifices 124 as shown in the diagram of FIG. 12.

Depending on the intended application of the element of multi-directional structure, the assembly held in its expanded state may include rigid sheets 123 and flexible tubes 121.

If the cells are closed, an inflating agent may be placed in each cell during initial assembly and inflation may be triggered when all the welding or gluing has been completed.

FIGS. 13 and 13B are perspective views of parts 131 and 133 prepared for being assembled to parts 130 and 132 as shown in FIG. 13A to constitute another embodiment of the invention as shown in FIG. 4. It may be observed that the parts 130 and 132 are identical to each other as are the parts 131 and 133. The parts 130 and 1323 are constituted by four identical tetrahedrons 134, 135, 136, and 137 which are interconnected at their vertices and by plane faces 138 and 139. Such a construction may be made by gluing or welding. The parts 131 and 133 may be constituted solely by faces 140, 141, and 142, or else they may further include faces 143 and 144 in order to increase structural strength in another three-dimensional direction.

Figure 16:
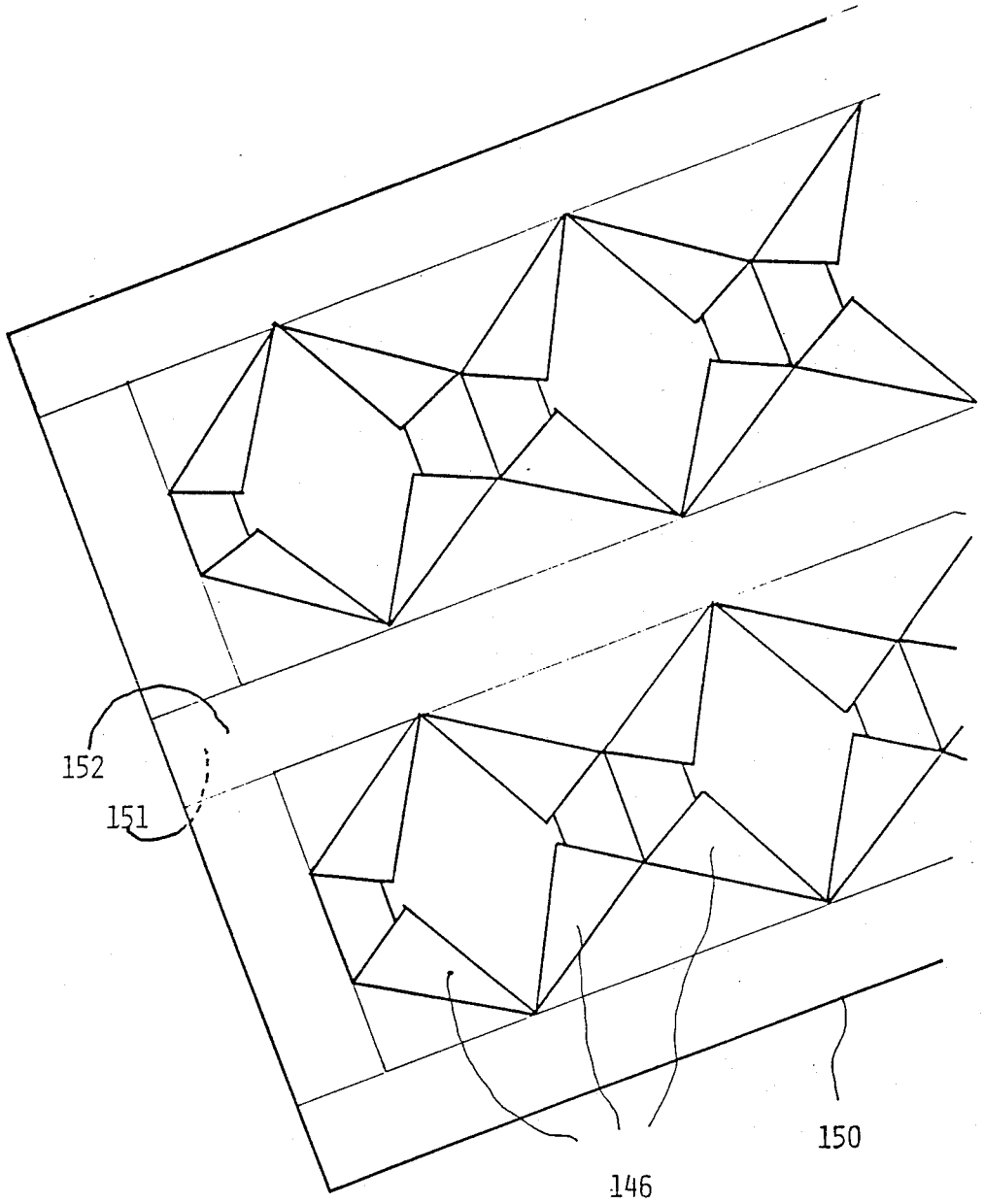

When such parts are assembled, they constitute an element such as that shown in FIG. 6. FIGS. 14 to 17 show a method analogous to that described with reference to FIGS. 10 to 12 but for making a structural element such as that shown in FIG. 6. Parts 146 (FIG. 14) correspond to the shaded faces 137A, 139 and 134A of FIG. 13, after being suitably cut out along the dashed line of FIG. 14 and folded forwardly along dot-dash lines and backwardly along circle-dash lines shown partially folded in FIG. 15, and are then glued along their edges as shown in FIG. 16 to a sheet 150 to constitute parallel rows in which they are alternately placed in one direction and then in the opposite direction. Several identical assemblies are made and superposed by gluing two adjacent sheets together along strips parallel to the rows of parts 146, with the strip 152 of the top sheet running between the parts 146 being glued to the strip 151 being glued to the strip 151 of the bottom face between the groups of parts 146.

Figure 17:
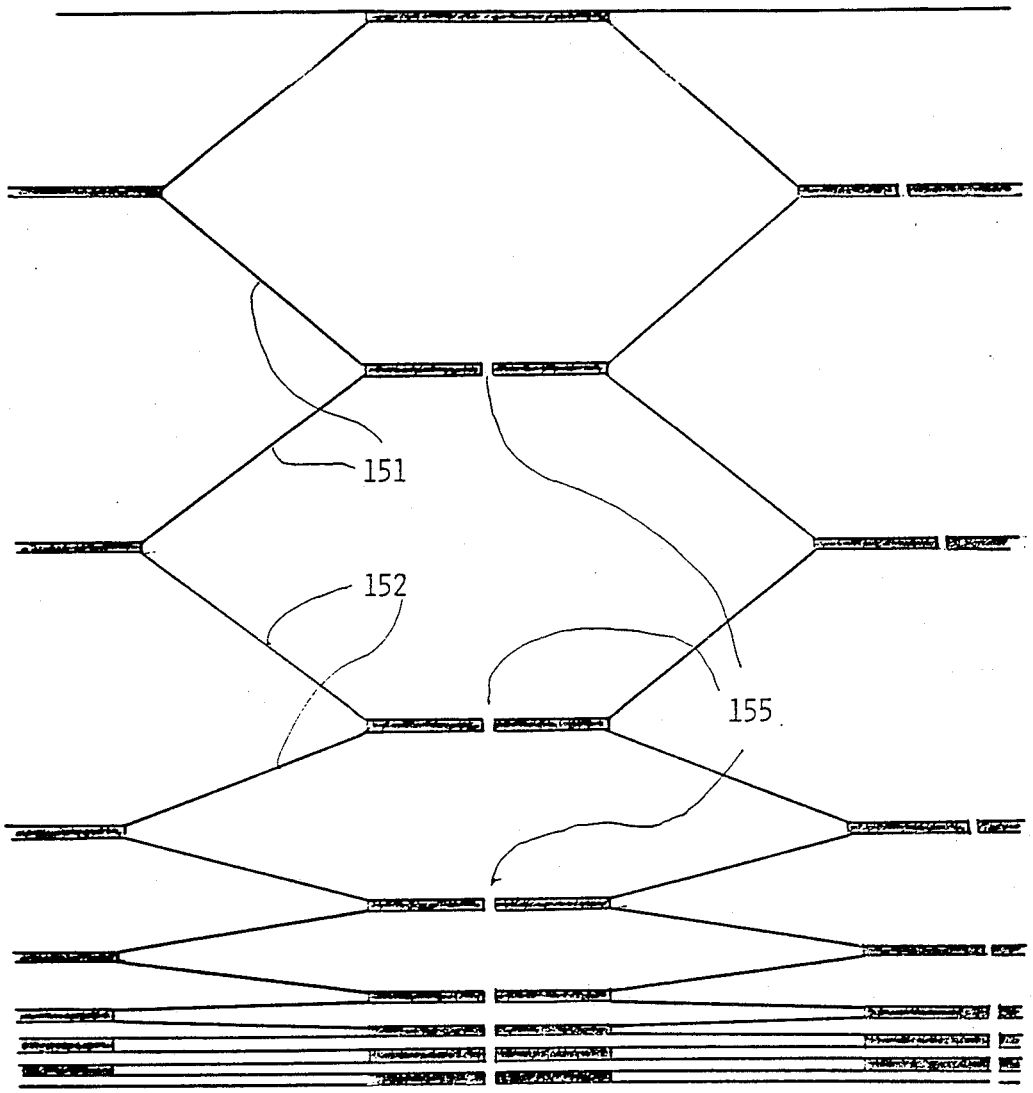

The expansion operation is shown diagrammatically in FIG. 17 where the cells are shown intercommunicating via openings 155.

When the structure is flexible and has intercommunicating cells, a polymerizable liquid material may be injected into the structure under non-polymerizing conditions and then the liquid is drained so as to leave a certain quantity of liquid uniformly distributed over the walls, with said quantity depending on the thixotropic adjustment of the liquid and on the degree to which it impregnates the walls. In use, the structure is inflated under polymerization conditions and becomes rigid.

As mentioned above, all of the structures may be used as described: rigid, flexible and inflatable/deflatable, or flexible and rigidifiable with or without an external mold.

A structure may also be used as a blank, to constitute a mold which is filled with a substrate, the structure is then eliminated (by subliming, dissolving, melting, etc. . . .). There remains a mold made of the substrate which can then be used to make a new structure by casting, thereby obtaining different mechanical properties. The cast material may be a metal, an alloy, a fiber-reinforced substance or resin, with random or oriented fibers, etc. . . . The substrate mold is then eliminated by any appropriate method: dissolving, subliming, etc. . . . , or it is merely retained.

In a variant, the substrate can itself be expanded by temperature, pressure, etc., after the hardenable material has been injected therein, thereby exerting pressure on all of the walls of the structure inside the volume-containing mold, thus further reinforcing the mechanical qualities of the assembly.

FIG. 18 is a diagrammatic perspective view of a set of seven hexagonal cylinders which have been assembled and crosslinked in accordance with the present invention. This can provide a body having a central axis of symmetry such as a pole, a mast, etc. . . . , which may be fixed or rotary such as a transmission shaft, a centrifuge, etc. . . . The number of cylinders is not limiting and further concentric layers could be provided with or without additional peripheral cylinders of different sections.

APPLICATIONS

There follows a description of a few implementations of the invention selected from the numerous applications possible, and given by way of example. These implementations include: a precision bench; constructing an annular self-supporting roof vault for a flexible and inflatable/deflatable shelter; a variant having an annular rigidifiable disposition; constructing a safety door or a door for a hardened hangar together with a variant for closing a silo; a filter element; and a supporting cabinet for electronic equipment.

CONSTRUCTION OF A SELF-SUPPORTING PRECISION BENCH OF HIGH RIGIDITY AND EXCEPTIONAL DIMENSIONAL STABILITY

In meterology, and in aviation and space applications, there is a constant search for high rigidity associated with reduced weight. In addition, the use of very high accuracy optical or other means requires the use of supports having very high dimensional stability under very difficult conditions of use: acceleration, pressure, temperature, etc. . . .

The principle of the invention can be applied to a structure of this type in which the faces of the envelope are constituted by a trellis-work of superposed crossing strips of parallel fibers such that at least two of the axes of the planes of the fibers are perpendicular, or such that they are parallel to a common plane but in several different directions, with each of them being at the same angle to the axis of the longitudinal direction of one of the planes of fibers.

The faces of the envelope are integral portions of a core of perpendicularly oriented cells extending in all three dimensions with each of the planes constituted by the cells being itself built up from strips of parallel fibers extending from one end of the volume to the other. The fibers are oriented by any suitable pneumatic, mechanical, or other means, e.g. magnetic field effect means, and they are assembled and rigidified by means of a temporary solidification material at a concentration matching that of the final solidification material.

The diversity and the characteristics of the materials and the fibers which can be used are considerable, and in order to clarify the description the following terms are used, although it should be understood that they are not limiting: the fibers are referred to as A; the final matrix as B (e.g. carbon/carbon) said matrix having a coefficient of expansion which is substantially zero (e.g. less than $10^{-6}$) for a temperature difference of several tens of degrees Celsius. The substrate C may be a phenyl-silicone expansible foam which expands and hardens at 60° C. and which melts at 300° C., the original blank may be made from polyethylene D which is thermo-formable at 100° C. together with a glue E, both of which melt at 150° C., and a starch solution F may be the material used for solidarization purposes enabling the fibers to be organized and manipulated.

For simple shapes, volumes made of C may be assembled and held together by glued wedges of substance B if the cells are to remain isolated, or by wedges of substance C in order to allow intercommunication between the cells.

For more complex shapes or shapes including warped surfaces using appropriate thicknesses of B, the outer planes are thermo-formed in a mold and are drilled, and then internally tapped sleeves are inserted and glued through the mold and the plates of D to open out largely in the volumes defining the projected cells. The cells are assembled with D in planes using E and taking care to retain the sleeved openings in the cells so that the assembly can be completely filled with fluid C through the bottom orifices and so that when the volume is tilted for draining, it retains a suitable quantity of the fluid C in each cell. A suitable quantity of pins are mounted to center the future mold and, with the structure at the same slope, it is heated to 60° C. causing C to expand and harden, and it is then heated to 150° C. causing D and E to melt and be eliminated. The volumes are now held together by their intercommunication orifices which are filled with C, and it is held centered in the mold by the fixed pins of C.

After noting the lengths of the centering pins, the core is taken out from the mold and strips of fibers are engaged in a first series of parallel planes while leaving the intercommunication channels. F is dissolved along the lines of intersection with other perpendicular planes, and new strips are engaged therein, with the binder F being dissolved along new lines of intersection with other planes, and so on until all of the planes left empty by the removal of D have been occupied.

A trellis-work constituted by a plurality of strips of superposed crossed fibers is disposed over each face, taking care to keep the fibers away from the points where the pins pass and crossing them with the strips of fibers which are already in place. After folding down the fibers in appropriate directions, the assembly is replaced in the mold and centered.

The mold is closed and the binder F is dissolved using hot water, and after drying, the matrix B is injected to fix the fibers as it hardens. The mold is stood level and the substance C is eliminated by heating to 300° C.

The assembly is unmolded and its working face is rectified to within the specified tolerances leaving at least one opening which is open to the outside in order to avoid internal thermal stresses which can be damaging to the strength and the dimensional stability of the volume obtained.

It can then be filled with any fluid or liquid metal.

APPLICATION TO AN INFLATABLE FLEXIBLE STRUCTURE

Flexible constructions and shelters are frequently used: tents, large scale domes, etc. They generally need to be held in shape by a frame, by excess internal pressure filling the entire volume they define, or by excess pressure in parallel cylinders which offer low resistance along the lines which join them. Heat losses increase with increasing volume. Holes due to chaffing and tearing can cause them to collapse or be destroyed.

An application in accordance with the principle of the invention enables such a self-supporting structure having a low coefficient of heat loss to be erected by using a cellular structure forming volumes which are isolated by non-return valves, thereby preventing it from collapsing in the event of perforation and having a disposition which considerably improves thermal insulation.

Tubular elements 201 (FIG. 20) are made so that their opposite faces 202 and 203 represent two portions of cylinders about a common center, with the smaller face having a radius equal to the inside of the vault, and with the larger face having a radius equal to that of the smaller face plus the height 204 of the cell 201 (FIG. 20), with the plane faces 205 and 206 lying in planes intersecting the cylinder of the vault and its axis of symmetry. The tube is delimited by faces 207, 208, 205, and 206. The tubes are flattened in conventional manner (FIG. 10) in an axial direction and in planes perpendicular thereto and edges such as the edges 122 shown in FIG. 10 are provided thereon.

A sheet 209 (FIG. 21) is applied over a cylindrical former having the same diameter as the vault to be made, the flattened cells 201 are fixed thereto by the rims around their bottom portions in parallel rows in which they are disposed so that the faces 205 and 206 are parallel to the generator line of a cylinder and so that they alternate in opposite directions (FIG. 21), and a second sheet 209 is applied so that the top rims of the cells adhere to the bottom portion of the new sheet.

New tubular elements are made in accordance with FIG. 21 and the above description, but with the base planes of the new cells 211 being the same size as the top planes 203 of the cells 201, so that the faces 207 and 212 lie in the same plane as do the faces 208 and 213, the faces 205 and 214, and the faces 206 and 215. The flattened cells are fixed to the sheet 209 as described above, with the surfaces 203 and 216 being superposed, and then another sheet is applied and then a new type of cell 216 is fixed thereto constructed to bear the same ratio to the cells 211 as the cells 211 bear to the cells 201, and a new sheet is applied, etc.

A series of annular volumes are thus obtained as shown in FIG. 22 which volumes can be inflated by the means shown in FIG. 12.

As shown in FIG. 23, non-return valves 220 are provided on intercommunication orifices through the sheet 209 so that fluid injected between the sheets 209 and 219 can pass into a volume defined by the sheets 219 and 229. Similarly, nonreturn valves are provided on the sheet 239 so that fluids inserted between the sheet 239 and the sheet 229 can pass between the sheets 229 and 219.

One or more multi-way valves 221 fitted with safety valves for releasing excess pressure are advantageously used to interconnect the volumes in a controllable manner so that they are either isolated from each other or else in communication with one another to ensure pressure and temperature equilibrium between the layers of cells.

The tubes 201 shown in FIG. 20 may be flattened by selecting the faces 205 and 206 as bases which then constitute portions of the fixing sheets. The superposed tubes should be of the same size. The resulting structure would then be constituted by annular tubes having a diameter such that the centers of all the generator lines of the tubes constituting circular arcs meet along the axis of symmetry of the vault.

These dispositions serve to organize all kinds of fluid flow through the volume, through a portion of the volume, through a tube with or without a manifold, and all of which may be fitted with multi-way valves.

An inflatable structure in accordance with a principle of the invention and organized as intercommunicating cells with or without non-return valves is capable, after construction, of being made rigid in at least two different ways. Firstly, it may be made rigid by the method described in the application using an expansible foam, this is done by ensuring that each cell has openings so that the assembly can be completely filled with foam components prior to expansion thereof and in such a manner that after being drained the volume retains a sufficient quantity of foaming substance in each cell, thereafter foaming is initiated.

Another method consists in selecting a resin G and a hardener H ready mixed, but such that polymerization can occur only in the presence of a substance I. A substance J leaves G and H unaffected. The structure is filled with G and H in suitable proportions, by adjusting the thixotropic nature thereof in such a manner that a certain quantity of substance remains on all of the cell walls. Excess G and H is drained and replaced with J. The assembly is deflated for storage and transport. When put into service, it is inflated with I being injected, thereby hardening all of the internal walls.

Among the other applications of the invention, there follows a detailed description of an armored door of variable inertia in accordance with the European patent application filed Jan. 10, 1985 under the number 85 400041-1, entitled "Variable inertia door for a building, said door having high impact strength."

When the door of a building, such as a hangar, is to be protected from projectiles, it may be clad in thick armor. However, this considerably increases the weight and the inertia of the door so that it becomes very difficult to manoeuver.

A door in accordance with the invention is characterized in that it is constituted by a sealed envelope which is divided by partitions into cells which intercommunicate via openings provided through the partitions and disposed in such a manner as to constitute baffles, which cells may be filled with liquid.

When the envelope is empty, it is relatively light and may be moved without difficulty.

When it is to be protected against impacts, it is filled with a high density liquid, or even simply with water. When an impact occurs on its outside face, the forces due to the impact spread into the door and are progressively damped by the head losses due to the baffles. The door has a very low penetration coefficient for nuclear radiation and is insensitive to electromagnetic flash.

Some of the cells may contain a hydraulic damper constituted by a compressible volume, thereby increasing the impact-absorbing capacity of the door.

The cells are advantageously shaped in such a manner that their front walls are in the form of a succession of planes which slope relative to the vertical. For example, they may have a cross-section which is hexagonal in shape (either regular or irregular) or square, having a horizontal diagonal plane. A horizontally travelling projectile therefore strikes the wall at a certain angle of incidence, thereby reducing its penetration power, which is reduced by about 45% when the angle of incidence is 60°. In addition, the projectile is deflected.

When the thickness of the envelope includes two or more superposed layers of cells, these layers are preferably staggered. The offset between the layers makes it possible to provide half as many cells for cells having front and back faces of the same strength. The door is thus lightened without losing rigidity.

When the front walls of the cells are in the form of an alternating succession of sloping planes, these walls are advantageously constituted by folded metal sheet with each of its flats being covered by an independent plate of impactresisting material, e.g. of steel or ceramic armor plate. The wall is thus very easy to make while still being very strong. Further, the change of material reduces the penetration power of the projectile which must pass, for example, successively through ceramic, steel, and liquid.

FIG. 24 shows a military building 1 which may be a personnel shelter or a hangar for housing military equipment. This building includes an opening 2 in one of its faces capable of being closed by a door 3. In the example shown, this door is slidably mounted with its bottom running on slideways 4 and with its top being held by a guide 5. However, naturally, the door could be mounted in any other manner, for example it could pivot about a vertical axis or even about a horizontal axis.

As can be seen particularly in FIGS. 25 and 26, the door 3 is constituted by a closed envelope 6 intended to be filled with a liquid such as water, and it is divided into cells such as 7 by longitudinally extending vertical partitions 8 (in this case three such partitions), by transversely extending vertical partitions 9, and by horizontal partitions 15. These cells are advantageously twice as wide as they are thick and about five times as high.

Each of the cells 5 other than those belonging to one of the outside walls of the envelope 6 has two openings 10*a* and 10*b* on its opposite vertical longitudinal faces, two openings 11*a* and 11*b* on its opposite vertical side faces, and two openings 12*a* and 12*b* on its opposite horizontal faces. The openings 10*a* & 10*b*, 11*a* & 11*b*, and 12*a* & 12*b* are disposed in a staggered configuration so that the walls of the cell constituted by the partitions 8 and 9 constitute baffles for the liquid contained in the envelope. They are also placed in such a manner as to avoid, as much as possible, any direct passage from any opening situated on one of the faces of the cell to the openings situated on the adjacent faces. Thus, for example, it can be seen in FIG. 26, that the opening 11*a* is not adjacent to the opening 10*a* nor is it adjacent to the opening 12*b*. The above-mentioned dimension ratios make this disposition easier to achieve. The openings 12*a* and 12*b* preferably extend over half the length of the horizontal faces of the cell and have the same width, they are therefore substantially square in the above example. The openings 10*a* and 10*b* and the openings 11*a* and 11*b* are of substantially the same size.

The cells adjacent to one of the outer walls of the envelope 6 have similar openings except in their faces constituted by the outer walls.

The envelope 6 is also connected to a supply duct 13 and to a drain duct situated over a gutter 14 (see FIG. 24).

In normal times, the envelope 6 is empty so that the door 3 is easy to operate.

When protection against impacts, e.g. from missiles, is required, the envelope 6 is filled with a liquid via the duct 13. The liquid enters the various cells by passing through the openings in the cells.

If a missile impacts against the outside face of the door 3, the forces exerted on said face by the impact diffuse into the inside of the door and are reduced each time they pass from one cell to another by virtue of the head losses due to the baffles constituted by the partitions 8 and 9. This missile is prevented from going through the door.

Thereafter, the door may be opened by emptying the liquid it contained into the gutter 14. It can then be manoeuvered without difficulty.

If so desired, a pneumatic emptying device may be provided to increase the rate at which the liquid runs out from the door so that the door is emptied quickly and can be opened more rapidly.

In the embodiment shown in FIGS. 25 and 27, each of the cells 7 is rectangular in cross-section, with the partitions 8 being vertical and the partitions 15 horizontal, as shown in FIG. 24.

However, the cells may also have a cross-section in the form of a regular hexagon, as can be seen for cell 7*a* in FIG. 28. The front face 6*a* of the envelope 6 thus presents a succession of flats sloping at 60° to the horizontal axis of the building. In the embodiment of FIG. 29, the cells 7*b* are square in section, with one of their diagonal planes being horizontal. In the embodiment of FIG. 30, the cells 7*c* have a cross-section in the form of a irregular hexagon each including two horizontal walls and four walls sloping at 45° to the horizontal. In these last two embodiments, the front wall 6*a* of the envelope 6 is constituted by a succession of flats sloping at 45° to the longitudinal axis of the building.

In the embodiment of FIG. 25, the door comprises three superposed layers of cells, with the cells in all three layers being disposed opposite one another. However, the cells in the various layers could also be in a staggered disposition as shown in FIG. 31. The back wall of a cell is thus stiffened by the partition 9 separating two cells in the layer immediately behind it. FIGS. 32 and 33 show how this disposition is applied to cells of hexagonal section.

When the front walls of the cells are constituted by a series of sloping flats, as in the embodiments shown in FIGS. 28, 29, and 30, the front wall may be constituted by a folded steel sheet with each of its flats being covered by a piece of armor plate specific thereto, said armor plate being made of steel armor plating or ceramic material, as shown at 16 in FIG. 30.

Naturally, the present invention is not considered as being limited to the embodiments described and shown, but on the contrary covers any variant or other embodiment, for example, so long as it employs the above-described principle of the invention.

When an access is to be protected, its closure may be protected by concrete or thick armor.

Its weight becomes considerable and the difficulties encountered in machining thick steel armor plates limit possible uses. Their deformability does not provide good sealing of the protected volumes, and requires the closure either to run on facade rails (FIG. 24) or else, under a vault, to remain perpendicular to the ground in two leaves rotating about vertical axis hinges and supported on running paths in the form of circular arcs. Further, under a vault the development of the opening motion is hindered by the radius of the vault, thereby requiring the vault to be considerably increased in size. In both cases, all the front portion of the structure and its closure remain highly vulnerable. In another technology, the cost and the consequences of using active armor limit the use thereof.

Another non-limiting application of the principle of the invention given by way of example concerns a safe closure such as the door of an armored hangar or any other protection providing high resistance to penetration by projectiles, by the effects of blast, by shock waves, by radiation, and being undeformable and self-supporting in order to ensure by virtue of its great rigidity good sealing to penetration (or exit) of chemical or bacteriological substances while offering the best coefficient of resistance to penetration by radiation. It must also be manoeuverable in as short a period as possible.

This application of the principle of the invention is to provide a door satisfying these constraints.

FIG. 34 shows a vault construction 240A which may, for example, be the safe access to a strategic site, a portion of a hangar for protecting military equipment, the entrance to a personnel shelter for anti-nuclear protection, for antibacteriological protection, for anti-chemical (NBC) protection, etc.

This volume is fitted with a door 240 (FIG. 35) held along its bottom by horizontal hinges 241 enabling it to pivot about the hinge axis and to be folded down into a horizontal position 242, thereby allowing free passage (FIG. 36).

The volume occupied by the opening and closing motion is very small and makes it possible to install a bulkhead 243 between the front of the vault and the plane of the raised door, with the bulkhead having an opening therethrough specifically designed to pass an aircraft, for example (see FIG. 37), or a bulkhead 243A (FIG. 38) specifically designed to pass a truck. The opening through the bulkhead may have any other appropriate profile to limit the effects of an explosion on the ground in front of the vault or of an explosive charge.

The ground portion of the hangar as covered by the folded down door when in the open position is advantageously dug to form a well 244 (FIG. 36) so as to increase as much as possible the volume situated between the bulkhead and the door, so that pressure exerted on the surfaces of this expansion volume is kept as small as possible. The organization and the slopes of the planes 245, 246, 247, and 248 constituting the front face (FIG. 39) are designed to be proportional to the desired strength and as a function of the distance of the door from the entrance to the vault such that in the event of any explosion on the ground in front of the vault (whose effects are reduced by the bulkhead 243 and the pressures reduced by expansion in the volume 244), the stresses to which the closure planes are subjected do not cause any movement in directions lying in the average plane of the door.

Indeed, if the door is a long way back from the entrance to the vault, the forces exerted thereon become parallel to the axis of symmetry of the half-cylinder of the vault, and the ends 249 and 250 of the straight line between the planes 245 and 246 meet at a point situated in the center of the door.

In the example shown in FIG. 39, each of the portions of the door limited by the planes 245, 246, 247, and 248 is constituted by a sealed envelope comprising, for example, in the example shown, three layers of hexagonal section cells whose edges are at an angle of 30° to one another and with the axes of the cylinders constituted thereby lying in a plane parallel to the axis of symmetry of the vault. A second series of cylinders intersects the first series such that the axes of the cylinders in the second series are perpendicular to the axis of symmetry of the cylinder of the vault, and a third series of cylinders of rhombus cross-section have their cylinder axes extending perpendicularly to both of the other directions, as shown in FIG. 6.

The cells in the door may be filled with all kinds of mixtures, substances, etc. . . . However, if gases or air are used, the door should be slightly inclined towards the outlet from the vault when in its closed position so as to have a constant tendency to settle as it opens.

If full of liquid, the door should be sloped backwardly in the closed position (FIG. 36) so that by draining a portion of the volume the center of gravity of the assembly moves forwardly thereby causing the door to open.

The bearing face in the closed position is equipped with shock absorbing means 251 which, under the effect of blast from an explosion distributes the absorbed pressure inside the volume of the door via calibrated orifices through the planes constituting the cells, so that the absorbed energy is restored slowly in order to avoid unwanted rebounds. The hinge 241 may also be floatingly mounted on shock absorbers.

In order to provide sealing for applications where NBC protection as previously referred to is desired, a microwave seal is advantageously disposed between the bearing face of the door and the structure.

A series of counterweights, shown in FIG. 40, include a first counterweight 252 having a drainable volume 253 facilitating opening and closing as explained below.

By draining the volume 253, the counterweight 252 is guided to move a certain distance and then encounters a counterweight 254 which is held at a certain height, then it encounters a counterweight 255, and then it encounters a counterweight 256. The action of the counterweights increases with increasing door weight as the door slopes and the guide profile 256 effectively slows door motion until it is fully open.

The weight of the emptied counterweights is slightly less than the weight of the door in the horizontal position.

In order to close the door, the volume 253 is filled or the door is drained by a corresponding amount, and the return assembly raises the door to the closed position. The counterweight 256 moves down only to its stop position where it is the only counterweight to be held, thereafter the counterweight 255 and then the counterweight 254 are each stopped in their respective stop positions before the counterweight 252 returns to the end of its stroke.

The door sloping slightly rearwardly is then refilled.

The same motion may also be provided using rams 258 as shown in FIG. 41.

The rear portion of the door is plane, and the junction between this plane and the rear faces of the structure only need to be strong enough to support the rolling loads carried when the door is horizontal, and can be provided either by larger cells having thinner walls, or else simply by suitably spaced fixed struts (259 in FIG. 41).

The closed assembly provides protection such that in the event of an explosion on the ground at the entrance to the vault, the pressure set up thereby is reduced by the bulkhead 243 and is allowed to expand in the expansion volume 244.

A projectile moving towards the entrance along a trajectory which is substantially parallel to the longitudinal axis of the vault will strike the front face of the door at an angle which cannot be less than 60°. If it penetrates into the structure, it encounters an armored plane sloping at a different angle to the first armored plane, and then yet another plane at yet another slope, and so on throughout the thickness of the structure.

Very hard plates, e.g. ceramic plates or reinforced resins such as carbon/carbon or sandwiches of different materials providing high thermal and mechanical resistance are fixed on the exposed faces of the closure to prevent penetration.

The core of the structure absorbs a portion of the received energy by deforming and distributes the energy throughout the volume.

The fluids contained therein are hindered in their displacement by the baffle-type disposition of the openings and therefore assist in absorbing the forces exerted thereon.

Compression volumes may be provided to allow fluid circulation and to help absorb pressure.

In conclusion, the successive changes of incidence and of impedance prevent penetration, and the movement of the fluids flowing through the calibrated orifices disposed to constitute baffles transforms all of the applied forces, including those due to an internal explosion, into a pressure distribution within a sphere.

In a variant application of the principle of the invention as described above, a plurality of panels disposed as shown in the section of FIG. 42 and the plan view of FIG. 43 may advantageously be joined together to protect a vertical cylinder such as a silo, while still providing quick and reliable retraction of the opening in order to eject any kind of bodies, missiles, for example.

Another non-limiting example implements the principle of the invention in the construction of safety containers for transport and storage.

About thirteen million chemical compounds are known, and about fifty to sixty thousand are used commercially. New molecular and cellular knowledge is making it possible to increase this number by five hundred to a thousand per annum. Substances manufactured on an industrial scale include: enormous quantities of chlorine, ammonia, hydrogen cyanide, and phosgene, together with methyl isocyanate (M.I.C.), benzene, trichlorophenol, dioxin, nerve gases, psychotropic gases, emetic gases, etc. . . .

Together with liquefied gases and hydrocarbons, millions of tons of dangerous substances are transported and stored annually.

Safety containers for transporting radioactive substance are made of steel having a thickness of about one hundred and twenty millimeters, and are cylindrical in shape. In order to satisfy regulations concerning the attenuation of radiation, withstanding a fall through a certain distance, and withstanding the effects of a hydrocarbon fire for a certain length of time, their empty weight comes up to seventy (metric) tons.

It is particularly difficult to find a better empty weight to loaded weight ratio. Further, protection against fire, radiation, gas, chemical agents, and the constant pressure of specialized inhibitors in the proximity thereof appear to be difficult to satisfy simultaneously if the container is also to withstand possible impacts from projectiles.

The principle of the invention can be applied to satisfying these requirements simultaneously.

For example, the container may be constructed in the manner described with reference to FIG. 25 comprising a plurality of volumes as described or constituted by hexagonal section cylinders such as shown in FIG. 6, or in a disposition as shown in FIG. 45 for two plane faces, or else as shown in FIG. 46 so that the outside face 265 can withstand impacts from projectiles as explained above.

The volumes 262, 263, and 264 are isolated from one another and the cells constituting them are in intercommunication.

A vertical section (FIG. 47) perpendicular to the longitudinal axis of the container shows three superposed envelopes, constituted by three series of cylinders 111, 112, and 113 (FIG. 6). The elements 270, 271 and 272 shown in FIG. 47 are manometers, illustrated to point out that there are three distinct volumes in the structure, cells of each volume communicating through apertures.

A substance A having a critical point of 70° C. is to be transported, protected, and destroyed in the event of an accident. In addition, A emits radiation which is stopped by a substance B. Substance C is an inhibitor for A. The volume 263 may remain unused or it may communicate with the volume 262 or the volume 264.

The volume 264 is filled with a fluid including a fireextinguishing agent D. The partition 266 is lined with B as are the sloping walls of the cells of volume 262. The C in volume 262 may be under thermostatic control. If A reaches its critical point, fuses will release C which will inhibit A and confine it in the enclosure and in volume 262.

If the assembly is subjected to an excessive outside temperature from a hydrocarbon fire, the heating of D will increase the pressure in the volume included in 264, thereby releasing the fire-extinguishing agent via pressure-sensitive fuses 268. In order to increase the degree of safety, the fuses 268 may additionally be responsive to temperature. The faces 265 and other faces oriented in the same direction in the structure may be covered with impact-resistant substances, as described in the armored door application.

The faces 266 and those oriented in the same direction in the structure may be covered with substances which withstand the effects of A.

The example is not limiting, and all sorts of applications can be combined: construction materials; reinforcing materials; fuses; pressures; temperatures; etc.

The structure advantageously includes lines of cells extending longitudinally, laterally, and diagonally, said cells having reinforced and thicker walls and constituting an internal frame adapted to the weight of the assembly and to the required performance thereof.

For transport when empty, the assembly may be drained.

Openings or panels 269 are joined by inter-fitting without affecting the rigidity of the assembly by applying the principle shown in FIG. 48. Sealing members may be provided. Interconnection is provided by pins 278 running along the axes of cylinders which extend in the same direction.

Another application of a principle of the invention relates to elements for filtering or for pervaporization. The possibilities described are not limiting.

Filters made of polymers or of cellulose acetate suffer from thermal constraints and from low strength against pressure differences such that inorganic membranes, e.g. made of carbon, zirconia, alumina, titanium oxide, etc. . . . having very small pore diameters (from 20 Angströms) are preferred. The capacities of filter elements in reverse osmosis, in microfiltration, and in ultra-filtration are limited by their exchange surfaces and filter elements are characterized by their relative fragility.

In contrast, a very high degree of control over the porosity of their component substances or of their application as a coating is available.

The great strength of an elements having structure such as that shown in FIG. 18 or in the volumes as shown in FIGS. 6 and 8, and the large surface areas they present in a small volume, make it possible (depending on the porosity or the degree of sealing of the partitions) to construct filter elements capable of being used in reverse osmosis, micro-filtration, ultra-filtration, or a combination thereof, and employing frontal or tangential filtering techniques.

In FIG. 18, since the ends of the vertical cylinders are closed, pressures exerted from the outside towards the central cylinder are such that the peripheral planes of greater porosity are subjected to a greater fluid pressure difference, thereby giving rise to filtering with a residual pressure relative to the central cylinder. The fluid is already purified and the partitions of the inner cylinder can be of smaller porosity.

Using the elements shown in FIG. 6, by virtue of some non-porous faces a series of cylinders 111, 112, or 113 may serve as a drain for removing the permeate.

A series of cylinders 161, 170, 171, 180, 181, 190, and 191 is made of a macro-porous body using a ceramic having porosity A (pores of about 15 microns), the outside of faces 182, 183, and 184 of the cylinder 180 receives a layer of cellulose acetate or of polymer or a slip of ceramic such that after appropriate treatment it has a porosity of 1,000 Angströms, for example. The insides of the faces 185, 186, and 187 also receive layers which, after treatment, have a porosity of 500 Angströms. Inserts of macro-porous substance are made for engaging in the tubes defining the inside shapes as shown in FIG. 6.

Their faces may have surfaces of different porosities or they may be sealed so as to constitute drains for collecting the permeates. These inserts form an integral body with the cylinders of the first series via ceramic links.

The disposition of the types of element implementing the invention makes it possible using three cylinder axes to organize a complex filter structure with incorporated drains by a suitable combination of porous surfaces and non-porous surfaces.

In order to backwash the filter element, when using a ceramic and a slip, a back pressure is applied to the collector drains and a cleaning fluid is centrifuged by rotating about the axis of cylinder 161 (FIG. 18).

Another application of the principle of the invention lies in the electronics industry.

Present super-computers are constructed using the socalled "Von Neumen" architecture (sequential mode SISD). Future computer systems for processing knowledge (KIPS), with so-called parallel architectures such as S.D.I.M.D. or M.I.M.D., or even L.A.U. run into two physical problems: the use of high-speed bipolar components gives rise to high consumption of electrical energy and thus generates considerable quantities of heat; and modern sequential or parallel types of architecture require up to 700 kilometers of interconnections to be cabled in a single unit.

The principle of the invention is applicable, in this case, as a physical organization of a multi-directional structure in close correlation with the technical design of computer systems, and in particular as shown in FIG. 19.

The tubes 161, 170, 180, and 190 form parts of a common porous substrate (having 15 micron pores, for example) and serves as a structural support for the assembly. The faces common to the cylinders 161 & 170, 161 & 181, and 161 & 190 are covered with a layer having a porosity of 2 micros. The other three faces of the cylinder 161 are covered with a layer having a porosity of 0.5 microns.

The faces 182 & 192 of cylinder 190, the faces 173 & 193 of cylinder 170, and the faces 172 & 183 of the cylinder 180 have porosities of 0.5 microns. All the outside faces 194, 195, and 196 of the cylinder 190 are sealed, the same is true of the outside faces of the cylinders 170 and 180.

By means of openings 138, 139, 137*a* and 134*a* through the inside planes (FIG. 13) and of the symmetry in items 131 and 132 together with the planes 143 and 144 of the item 133 and their symmetrical representatives in item 131, a thermostatically controlled flow of cold and filtered gas is regulated, e.g. in such a manner that each of the cylinders receives an equal fluid pressure along its entire length.

The cooling fluid injected into the cylinder 161 of FIG. 19 diffuses into the structure as a whole, in part directly, and in part through the walls of the adjacent cylinders.

The porosities of the common faces of the cylinders 161 to 170, 180 and 190 are designed to take account of head losses.

The sealed faces of the cylinders 170, 180, and 190 may, in order to provide pressure equilibrium, include exhaust windows such as 178 in cylinder 170 of low porosity and included in the sealed portions. The cylinders may be closed at their ends.

As a result all of the cylinders are cooled in controlled manner, and in particular the cylinders 171, 181, and 191 whose three outside faces pivot about vertical axes 187 and 197, and as shown about the axis 177 (FIG. 19).

The cylinders may be of any length.

The central computing members are mounted on a sliding frame which is conically insertable inside the cylinder 161 made of any plane shape.

Specialized processors, on plug-in cards, are fixed on the inside planes of the cylinders in dispositions shown in FIG. 19 inside an opening cabinet 171, in its fixed portion and in its door. The connections are made in the closed position along lines of connectors 198 and 199.

The cards may themselves be made on a porous or sealed substrate and may include windows of determined porosity.

The connections between the central processors and the peripheral processors are thus made as short as possible and the transmission times are appreciable reduced in the assembly whose temperature is thermostatically controlled by a directed flow such that the cooling is modulated depending on the particular zone or processor in question.

The same principle can be used for storing or processing data on any medium.

The read/write member may be rotary in the central cylinder or it may be outside it, the data media being located in front thereof by rotation of the assembly about the axis of symmetry of the cylinder 161.

I claim:

1. An element of multi-directional cellular structure formed by a plurality of series of hollow closed shell-like elements each of polygonal section which intersect, each of said series being composed of a plurality of convex closed prismatic shell-like elements of a same direction which are joined by one common plate face, wherein only the shell-like elements of a same series have common face planes, and the intersections of the shell-like elements define juxtaposed cells, each edge on one shell-like element of a given direction intersecting at least one edge of a shell-like element of another direction and each edge of each cell being entirely contained in the intersection of the planes of the shell-like elements.

2. A self-supporting element according to claim 1, wherein said series of cylinders intersect at an angle.

3. A self-supporting element according to claim 2, wherein said cylinders have a rectangular shape in section.

4. A self-supporting element according to claim 2, wherein said cylinders have a triangular shape in section.

5. A self-supporting element according to claim 1, wherein said series of cylinders have orthogonal directions.

6. A self-supporting element according to claim 1, wherein said cylinders have different shaped sections assembled in combination.

7. A self-supporting element according to claim 1, wherein juxtaposed cylinders in series have axes of symmetry that are concentric.

8. A self-supporting element according to claim 1, wherein said cylinders have axes which intersect a central axis at equal angles to each other.

9. A self-supporting element according to claim 1, further including a central cylinder.

10. A self-supporting element according to claim 1, wherein said element rotates about the axis of a central cylinder.

11. A self-supporting element according to claim 1, wherein said cells are isolated in groups.

12. A self-supporting element according to claim 1, wherein said cells are separately isolated.

13. A self-supporting element according to claim 1, wherein said cells intercommunicate.

14. A self-supporting element according to claim 1, wherein said cells have openings in staggered configuration to constitute baffles.

15. A self-supporting element according to claim 1, including means for cell intercommunication comprising nonreturn valves.

16. A self-supporting element according to claim 1, including means for cell intercommunication comprising fuses in the form of zones of weakness under the action of heat, of pressure, or of a chemical agent.

17. A self-supporting element according to claim 1, further including means in said envelope for freely opening to the outside.

18. A self-supporting element accordng to claim 1, further including means in said envelope for opening to the outside by fuses.

19. A self-supporting element according to claim 1, wherein said cells are filled with fluids.

20. A self-supporting element according to claim 1, further including substances in said cells that transform the physical characteristics of said fluids.

21. A self supporting element according to claim 1, wherein at least a portion of the cells contain a gas or a compressible material means for acting as a shock absorber.

22. A self-supporting element according to claim 1, wherein the inertia of the element varies by draining the fluids contained in its volumes.

23. A self-supporting element according to claim 1, wherein variation in the inertia displaces the center of gravity.

24. A self-supporting element according to claim 1, further including means connected to said element for removing fluid under gravity or under pressure.

25. A self-supporting element according to claim 1, wherein said planes are flexible.

26. A self-supporting element according to claim 25, wherein said planes are made rigid by hardening after the element has taken its final shape.

27. A self-supporting element according to claim 1, wherein said planes are rigid.

28. A self-supporting element according to claim 1, wherein the layers of cylinders are at least partially porous.

29. A self-supporting element according to claim 1, wherein the layers constituting other cylinders inserted inside a common series of cylinders are self-locking.

30. A self-supporting element according to claim 1, wherein said layers are formed of at least one of a synthetic, inorganic or composite material.

31. A self-supporting element according to claim 1, wherein said layers are formed of fibers, selected from the group comprising glass fibers, carbon fibers, and silicon fibers.

32. A self-supporting element according to claim 31, wherein said fibers are woven.

33. A self-supporting element according to claim 31, wherein said fibers are in random disposition.

34. A self-supporting element according to claim 1, wherein said layers are formed of at least one of metals or alloys.

35. A self-supporting element according to claim 34, wherein said ceramic is reinforced.

36. A self-supporting element according to claim 1, wherein said layers are composed by or covered in ceramics.

37. A self-supporting element according to claim 1, wherein said layers comprise porous bodies.

38. A self-supporting element according to claim 1, wherein said layers comprise bodies serving as substrates for a covering.

39. An element of multi-directional cellular structure comprising a plurality of series of cylinders having polygonal section, wherein said cylinders have in common the planes that define the juxtaposed cylinders having the same direction, and wherein said cylinders intersect to define juxtaposed cells, each edge of a cylinder of a given direction intersecting at least one edge of a cylinder of another direction and each edge of each cell being entirely contained in the intersection of the plane of said cylinders.

* * * * *